US012129556B2

(12) United States Patent
Illing et al.

(10) Patent No.: US 12,129,556 B2
(45) Date of Patent: Oct. 29, 2024

(54) CHEMICAL ACTIVATION OF SELF-PASSIVATING METALS

(71) Applicant: SWAGELOK COMPANY, Solon, OH (US)

(72) Inventors: Cyprian Adair William Illing, Cleveland Heights, OH (US); Peter C. Williams, Cleveland Heights, OH (US); Christina Semkow, University Heights, OH (US); Todd Johns, Solon, OH (US)

(73) Assignee: SWAGELOK COMPANY, Solon, OH (US)

( * ) Notice: Subject to any disclaimer, the term of this patent is extended or adjusted under 35 U.S.C. 154(b) by 131 days.

(21) Appl. No.: 17/112,076

(22) Filed: Dec. 4, 2020

(65) Prior Publication Data

US 2021/0172046 A1 Jun. 10, 2021

Related U.S. Application Data

(60) Provisional application No. 63/076,425, filed on Sep. 10, 2020, provisional application No. 63/017,265, (Continued)

(51) Int. Cl.
*C23C 8/22* (2006.01)
*C21D 1/06* (2006.01)
(Continued)

(52) U.S. Cl.
CPC ..... *C23C 8/22* (2013.01); *C21D 1/06* (2013.01); *C23C 8/26* (2013.01); *C23C 8/30* (2013.01); *C23C 8/32* (2013.01)

(58) Field of Classification Search
None
See application file for complete search history.

(56) References Cited

U.S. PATENT DOCUMENTS 1,772,866 A * 8/1930 Hirsch ..... C23C 8/62 407/119
2,789,930 A * 4/1957 Engelhard ..... C23C 8/26 148/230

(Continued)

FOREIGN PATENT DOCUMENTS

CN 1067929 1/1993
CN 102828145 12/2012

(Continued)

OTHER PUBLICATIONS

Agaponova. Encapsulation Method for Surface Engineering of Corrosion-Resistant Alloys by Low-Temperature Nitro-Carburization. Thesis. Case Western Reserve University. Jan. 2016. (Year: 2016).*

(Continued)

*Primary Examiner* — Paul A Wartalowicz
*Assistant Examiner* — Stephani Hill
(74) *Attorney, Agent, or Firm* — Calfee, Halter & Griswold LLP

(57) ABSTRACT

A method for treating a workpiece made from a self-passivating metal and having a Beilby layer is disclosed. The method comprises exposing the workpiece to the vapors produced by heating a reagent having a guanidine [HNC $(NH_2)_2$] moiety and complexed with HCl to activate the workpiece for low temperature interstitial surface hardening.

18 Claims, 10 Drawing Sheets

Related U.S. Application Data filed on Apr. 29, 2020, provisional application No. 63/017,271, filed on Apr. 29, 2020, provisional application No. 63/017,259, filed on Apr. 29, 2020, provisional application No. 63/017,262, filed on Apr. 29, 2020, provisional application No. 62/922,241, filed on Dec. 6, 2019.

(51) Int. Cl.

| | |
|---|---|
| ***C23C 8/26*** | (2006.01) |
| ***C23C 8/30*** | (2006.01) |
| ***C23C 8/32*** | (2006.01) |

(56) References Cited

U.S. PATENT DOCUMENTS

| | | | | |
|---|---|---|---|---|
| 3,232,797 | A | 2/1966 | Bessen | |
| 4,036,482 | A * | 7/1977 | Kieferle | C23C 8/22 266/252 |
| 4,844,949 | A | 7/1989 | Arai | |
| 5,014,646 | A | 5/1991 | Ito et al. | |
| 5,443,662 | A | 8/1995 | Arai et al. | |
| 5,556,483 | A | 9/1996 | Tahara et al. | |
| 5,593,510 | A | 1/1997 | Tahara et al. | |
| 5,745,834 | A | 4/1998 | Bampton | |
| 5,792,282 | A | 8/1998 | Tahara et al. | |
| 6,093,303 | A | 7/2000 | Williams et al. | |
| 6,165,597 | A | 12/2000 | Williams et al. | |
| 6,547,888 | B1 | 4/2003 | Williams et al. | |
| 8,414,710 | B2 | 4/2013 | Minemura et al. | |
| 8,784,576 | B2 | 7/2014 | Somers et al. | |
| 8,845,823 | B2 | 9/2014 | Christiansen et al. | |
| 9,738,962 | B2 | 8/2017 | Bremer et al. | |
| 10,214,805 | B2 | 2/2019 | Williams et al. | |
| 10,604,832 | B2 | 3/2020 | Williams | |
| 11,193,197 | B2 | 12/2021 | Illing | |
| 11,473,183 | B2 | 10/2022 | Williams | |
| 11,649,538 | B2 | 5/2023 | Illing | |
| 2002/0014281 | A1 * | 2/2002 | Heishi | C23C 8/26 148/230 |
| 2004/0175407 | A1 | 9/2004 | McDaniel | |
| 2006/0090817 | A1 | 5/2006 | Somers et al. | |
| 2011/0123907 | A1 | 5/2011 | Yau | |
| 2012/0111456 | A1 | 5/2012 | Christiansen et al. | |
| 2013/0136868 | A1 | 5/2013 | Bruck et al. | |
| 2013/0240090 | A1 * | 9/2013 | Watanabe | C23C 8/64 148/237 |
| 2016/0032442 | A1 | 2/2016 | Williams et al. | |
| 2016/0298203 | A1 | 10/2016 | Hackel | |
| 2017/0165791 | A1 | 6/2017 | Kamachi | |
| 2017/0166986 | A1 | 6/2017 | Schiroky | |
| 2018/0119239 | A1 | 5/2018 | Tuffile | |
| 2019/0376173 | A1 | 12/2019 | Illing | |
| 2020/0283882 | A1 | 9/2020 | Williams | |
| 2021/0134065 | A1 | 11/2021 | Semkow | |
| 2021/0340659 | A1 | 11/2021 | Semkow | |
| 2022/0064778 | A1 | 3/2022 | Illing | |
| 2022/0072618 | A1 | 3/2022 | Illing | |
| 2022/0364216 | A1 | 11/2022 | Ernst | |
| 2023/0015135 | A1 | 1/2023 | Williams | |

FOREIGN PATENT DOCUMENTS

| | | | | |
|---|---|---|---|---|
| CN | 103215536 | | 7/2013 | |
| CN | 103314132 | | 9/2013 | |
| CN | 105328185 | | 2/2016 | |
| DE | 4342730 | | 6/1995 | |
| EP | 516899 | | 12/1992 | |
| EP | 787817 | | 8/1997 | |
| EP | 1544318 | A1 * | 6/2005 | B01J 27/06 |
| EP | 2278038 | | 1/2011 | |
| GB | 1023337 | * | 3/1966 | |
| JP | S50-109827 | | 8/1975 | |
| JP | S52128847 | | 10/1977 | |
| JP | H05-202464 | | 8/1993 | |
| JP | H08-104972 | | 4/1996 | |
| JP | 9-071853 | | 3/1997 | |
| JP | 9-268364 | | 10/1997 | |
| JP | 2005-232518 | | 9/2002 | |
| JP | 2005-532471 | | 12/2005 | |
| JP | 2009-517542 | | 4/2009 | |
| SU | 1687645 | A1 * | 10/1991 | |
| WO | 2006136166 | | 12/2006 | |
| WO | 2011/009463 | | 1/2011 | |
| WO | 2015066320 | | 5/2015 | |
| WO | 2016/027042 | | 2/2016 | |
| WO | 2019/241011 | | 12/2019 | |

OTHER PUBLICATIONS

SU 1687645 machine translation (Year: 1991).*

Ge et al., "The effect of surface finish on low-temperature acetylene-based carburization of 316L Austenitic Stainless Steel", Metallurgical and Materials Transactions B, vol. 45B, Dec. 2014, pp. 2338-2345.

Stickels, "Gas Carburizing", ASM Handbook, vol. 4, Heat Treating, pp. 312-324, 1991.

Johnson et al., "Chemisorption and thermal decomposition of methylamine on the ruthenium (001) surface", J. Am. Chem. Soc. vol. 114, No. 11, pp. 4279-0490, May 1992.

Bond, "The role of carbon deposits in metal-catalysed reactions of hydrocarbons", Applied Catalysis A: General., vol. 149, No. 1, pp. 3-25, Jan. 1997.

Zhu et al., "Graphitic Carbon Nitride: Synthesis, Properties, and Applications in Catalysis", ASC Applied Materials & Interfaces, vol. 6, No. 19, pp. 16449-16465, Oct. 2014.

Stag Melissen et al., "DFT Perspective on the Thermochemistry of Carbon Nitride Synthesis", J. of Physical Chemistry C. vol. 120, No. 43, pp. 24542-24550, Nov. 2016.

Schaber et al. "Thermal decomposition (pyrolysis) of urea in an open reaction vessel", Thermochimica Acta. 424, pp. 131-142 (2004).

Shen Chengjin et al., "Heat Treatment of Materials and Surface Engineering", China Mining University Press, p. 218.

International Search Report from PCT/US2020/063284 dated Apr. 13, 2021.

Office action from Chinese Application No. 202011268560.7 dated Aug. 10, 2022.

Communication from European Application No. 22177892.1 dated Oct. 11, 2022.

Interntional Search Report and Written Opinion from PCT/US2015/042785 dated Oct. 28, 2015.

Search Report from European Application No. 15828180.8 dated Feb. 20, 2018.

Office action from Chinese Application No. 201580040222.9 dated Aug. 14, 2018.

Notice of Allowance from U.S. Appl. No. 14/813,290 dated Oct. 17, 2018.

International Search Report and Written Opinion from PCT/US19/035694 dated Aug. 2, 2019.

Office action from Japanese Application No. 2020-567961 dated Oct. 31, 2023.

Anh et al. "First-principles study of hydrogen-enhanced phosphorus diffusion in silicon", Journal of Applied Physics, 119, 8 pgs., (2016).

Edelmann, Chapter Two, "Recent Progress in the Chemistry of Metal Amidinates and Guanidinates: Syntheses, Catalysis and Materials", Advances in Organometallic Chemistry, vol. 61, p. 2 (Scheme 2.1) and p. 4 (Scheme 2.2), (2013). (submitted in two separate PDF's due to size limitation).

Gu et al. "Numerical Simulations of Carbon and Nitrogen Composition Depth Profiles in Nitrocarburized Austenitic Stainless Steels", Metal. and Mater. Transactions A, 45A, pp. 4268-4279 (2014).

Guanidine Hci 6M—GMP Denaturant, Bio Pharma Grade, GH4120, CAS#50-01-1, 2 pgs., Apr. 25, 2021.

Kuncicka et al. "Advances in metals and alloys for joint replacement", Progress in Materials Science, 88, pp. 232-280, 2017.

(56) References Cited

OTHER PUBLICATIONS

Netzsch brochure, Fourier Transform Infrared (FT-IR) Spectrometers Coupled to Thermal Analysis, 24, pgs, date unknown but at least as early as the filing date of this subject application.
Palmer et al. "Preparation and Extraction of INsuluble (Inclusion-Body) Proteins from *Escherichia coli*", 1 pg., copyright 2000.
Ren et al. "Ultrahigh-strength AISI-316 austenitic stainless steel foils through concentrated interstitial carbon", Acta Materialia, 167, pp. 231-240 (2019).
Ren et al. "Electronic impact of concentrated interstitial carbon on physical properties of AISI-316 austenitic stainless steel", Acta Materialia, 173, pp. 96-105 (2019).
Schneider, et al. Introduction to Surface Hardening of Steels, ASM Handbook, vol. 4A, Steel Heat Treating Fundamentals and Processes, copyright 2013, pp. 389-398.
Silcotek, "Impoving Corrosion Resistance in Biopharmaceuticals", one page, Apr. 25, 2021.
International Search Report and Written Opinion from PCT/US2021/029541 dated Aug. 5, 2021.
International Search Report and Written Opinion from PCT/US2021/049600 dated May 19, 2022.
International Search Report and Written Opinion from PCT/US2022/026640 dated Jun. 24, 2022.
Office action from U.S. Appl. No. 16/433,083 dated Apr. 21, 2021.
Notice of Allowance from U.S. Appl. No. 16/433,083 dated Aug. 4, 2021.
Office action from U.S. Appl. No. 16/832,253 dated Mar. 9, 2022.
Notice of Allowance from U.S. Appl. No. 16/832,253 dated Jun. 20, 2022.
Office action from U.S. Appl. No. 17/242,555 dated Mar. 13, 2023.
Notice of Allowance form U.S. Appl. No. 17/242,555 dated Jun. 22, 2023.
Office action from U.S. Appl. No. 17/470,287 dated Mar. 3, 2023.
Office action from U.S. Appl. No. 17/524,031 dated Aug. 6, 2022.
Notice of Allowance from U.S. Appl. No. 17/524,031 dated Dec. 12, 2022.
Office action from Japanese Application No. 2020-567961 dated May 23, 2023.
1 International Search Report from PCT/US2023/067444 dated Aug. 21, 2023.
Yari, "Nitriding for corrosion and wear fatigue resistance", 2020.
Office action from U.S. Appl. No. 17/470,287 dated Feb. 28, 2024.
Office action from Korean Application No. 10-2020-7035216 dated Jan. 12, 2024.
Office action from Japanese Application No. 2022-565720 dated Jul. 23, 2024.
Office action from U.S. Appl. No. 17/470,287 dated Aug. 14, 2024.

* cited by examiner

CHEMICAL ACTIVATION OF SELF-PASSIVATING METALS

CROSS-REFERENCE TO RELATED APPLICATIONS

This application claims priority to U.S. Provisional Applications: Ser. No. 62/922,241, filed Dec. 6, 2019; Ser. No. 63/017,259, filed Apr. 29, 2020; Ser. No. 63/017,262, filed Apr. 29, 2020; Ser. No. 63/017,265, filed Apr. 29, 2020; Ser. No. 63/017,271, filed Apr. 29, 2020, and Ser. No. 63/076,425, filed Sep. 10, 2020. The entire disclosure of each of these applications is incorporated herein by reference, and priority to each of these applications is hereby claimed.

BACKGROUND

Conventional Carburization

Conventional (high temperature) carburization is a widely used industrial process for enhancing the surface hardness of shaped metal articles ("case hardening"). In a commercial process, the workpiece can be contacted with a carbon-containing gas at elevated temperature (e.g., 1,000° C. or more) whereby carbon atoms liberated by decomposition of the gas diffuse into the workpiece's surface. Hardening occurs through the reaction of these diffused carbon atoms with one or more metals in the workpiece thereby forming distinct chemical compounds, i.e., carbides, followed by precipitation of these carbides as discrete, extremely hard, crystalline particles in the metal matrix forming the workpiece's surface. See, Stickels, "Gas Carburizing", pp 312 to 324, Volume 4, ASM Handbook, © 1991, ASM International.

Stainless steel is corrosion-resistant because the chromium oxide surface coating that immediately forms when the steel is exposed to air is impervious to the transmission of water vapor, oxygen and other chemicals. Nickel-based, cobalt-based, manganese-based and other alloys containing significant amounts of chromium, which can be 10 wt. % or more, also form these impervious chromium oxide coatings. Titanium based alloys exhibit a similar phenomenon in that they also immediately form titanium dioxide coatings when exposed to air which are also impervious to the transmission of water vapor, oxygen and other chemicals.

These alloys are said to be self-passivating, not only because they form oxide surface coatings immediately upon exposure to air but also because these oxide coatings are impervious to the transmission of water vapor, oxygen and other chemicals. These coatings are fundamentally different from the iron oxide coatings that form when iron and other low alloy steels are exposed to air, e.g., rust. This is because these iron oxide coatings are not impervious to the transmission of water vapor, oxygen and other chemicals, as can be appreciated by the fact that these alloys can be completely consumed by rust if not suitably protected.

When stainless steel is traditionally carburized, the chromium content of the steel is locally depleted through the formation of the carbide precipitates responsible for surface hardening. As a result, there is insufficient chromium in near-surface areas immediately surrounding the chromium carbide precipitates to form the protective chromium oxide on the surface. Since the corrosion resistance of the steel is compromised, stainless steel is rarely case-hardened by conventional (high temperature) carburization.

Low Temperature Carburization

In the mid 1980's, a technique for case hardening stainless steel was developed in which the workpiece is contacted with a carbon-containing gas at low temperature, e.g., below ~500° C. At these temperatures, and provided that carburization does not last too long, carbon atoms liberated by decomposition of the gas diffuse into the workpiece surfaces, which can be to a depth of 20-50 μm, without formation of carbide precipitates. Nonetheless, an extraordinarily hard case (surface layer) is obtained. Because carbide precipitates are not produced, the corrosion resistance of the steel is unimpaired, even improved. This technique, which is referred to a "low temperature carburization," is described in a number of publications including U.S. Pat. Nos. 5,556,483, 5,593,510, 5,792,282, 6,165,597, EPO 0787817, Japan 9-14019 (Kokai 9-268364) and Japan 9-71853 (Kokai 9-71853).

Nitriding and Carbonitriding

In addition to carburization, nitriding and carbonitriding can be used to surface harden various metals. Nitriding works in essentially the same way as carburization except that, rather than using a carbon-containing gas which decomposes to yield carbon atoms for surface hardening, nitriding uses a nitrogen containing gas which decomposes to yield nitrogen atoms for surface hardening.

In the same way as carburization, however, if nitriding is accomplished at higher temperatures and without rapid quenching, hardening occurs through the formation and precipitation of discrete compounds of the diffusing atoms, i.e., nitrides. On the other hand, if nitriding is accomplished at lower temperatures without plasma, hardening occurs without formation of these precipitates through the stress placed on the crystal lattice of the metal by the nitrogen atoms which have diffused into this lattice. As in the case of carburization, stainless steels are not normally nitrided by conventional (high temperature) or plasma nitriding, because the inherent corrosion resistance of the steel is lost when the chromium in the steel reacts with the diffusion nitrogen atoms to cause nitrides to form.

In carbonitriding, the workpiece is exposed to both nitrogen and carbon-containing gases, whereby both nitrogen atoms and carbon atoms diffuse into the workpiece for surface hardening. In the same way as carburization and nitriding, carbonitriding can be accomplished at higher temperatures, in which case hardening occurs through the formation of nitride and carbide precipitates, or at lower temperatures in which case hardening occurs through the sharply localized stress fields that are created in the crystal lattice of the metal by the interstitially dissolved nitrogen and carbon atoms that have diffused into this lattice. For convenience, all three of these processes, i.e., carburization, nitriding and carbonitriding, are collectively referred to in this disclosure as "low temperature surface hardening" or "low temperature surface hardening processes."

Activation

Because the temperatures involved in low temperature surface hardening are so low, carbon and/or nitrogen atoms will not penetrate the chromium oxide protective coating of stainless steel. Therefore, low temperature surface hardening of these metals is normally preceded by an activation ("depassivation") step in which the workpiece is contacted with a halogen containing gas such as HF, HCl, $NF_3$, $F_2$ or $Cl_2$ at elevated temperature, e.g., 200 to 400° C., to make the steel's protective oxide coating transparent to the passage of carbon and/or nitrogen atoms.

WO 2006/136166 (U.S. Pat. No. 8,784,576) to Somers et al., the disclosure of which is incorporated herein by reference, describes a modified process for low temperature carburization of stainless steel in which acetylene is used as the active ingredient in the carburizing gas, i.e., as the source compound for supplying the carbon atoms for the carburization process. As indicated there, a separate activation step with a halogen containing gas is unnecessary, because the acetylene source compound is reactive enough to depassivate the steel as well. Thus, the carburization technology of this disclosure can be regarded as self-activating.

WO 2011/009463 (U.S. Pat. No. 8,845,823) to Christiansen et al., the disclosure of which is also incorporated herein by reference, describes a similar modified process for carbonitriding stainless steel in which an oxygen-containing "N/C compound" such as urea, formamide and the like is used as the source compound for supplying the nitrogen and carbon atoms needed for the carbonitriding process. The technology of this disclosure can also be considered to be self-activating, because a separate activation step with a halogen containing gas is also said to be unnecessary.

Surface Preparation and the Beilby Layer

Low temperature surface hardening is often done on workpieces with complex shape. To develop these shapes, some type of metal shaping operation is usually required such as a cutting step (e.g., sawing scraping, machining) and/or a wrought processing step (e.g., forging, drawing, bending, etc.). As a result of these steps, structural defects in the crystal structure as well as contaminants such as lubricants, moisture, oxygen, etc., are often introduced into the near-surface region of the metal. As a result, in most workpieces of complex shape, there is normally created a highly defective surface layer having a plastic deformation-induced extra-fine grain structure and significant levels of contamination. This layer, which can be up to 2.5 μm thick and which is known as the Beilby layer, forms immediately below the protective, coherent chromium oxide layer or other passivating layer of stainless steels and other self-passivating metals.

As indicated above, the traditional method for activating stainless steels for low temperature surface hardening is by contact with a halogen containing gas. These activating techniques are essentially unaffected by this Beilby layer.

However, the same cannot be said for the self-activating technologies described in the above-noted disclosures by Somers et al. and Christiansen et al. in which the workpieces are activated by contact with acetylene or an "N/C compound." Rather, experience has shown that, if a stainless steel workpiece of complex shape is not surface treated by electropolishing, mechanical polishing, chemical etching or the like to remove its Beilby layer before surface hardening begins, the self-activating surface hardening technologies of these disclosures either do not work at all or, if they do work somewhat, produce results which at best are spotty and inconsistent from surface region to surface region.

See, Ge et al., The Effect of Surface Finish on Low-Temperature Acetylene-Based Carburization of 316L Austenitic Stainless Steel, METALLURGICAL AND MATERIALS TRANSACTIONS B, Vol. 458, December 2014, pp 2338-2345, 2104 The Minerals, Metal & Materials Society and ASM International. As stated there, "[stainless] steel samples with inappropriate surface finishes, due for example to machining, cannot be successfully carburized by acetylene-based processes." See, in particular, FIG. 10(a) and the associated discussion on pages 2339 and 2343, which make clear that a "machining-induced distributed layer" (i.e., a Beilby layer) which has been intentionally introduced by etching and then scratching with a sharp blade cannot be activated and carburized with acetylene even though surrounding portions of the workpiece which have been etched but not scratched will readily activate and carburize. As a practical matter, therefore, these self-activating surface hardening technologies cannot be used on stainless steel workpieces of complex shape unless these workpieces are pretreated to remove their Beilby layers first.

To address this problem, commonly-assigned U.S. Pat. No. 10,214,805 discloses a modified process for the low temperature nitriding or carbonitriding of workpieces made from self-passivating metals in which the workpiece is contacted with the vapors produced by heating an oxygen-free nitrogen halide salt. As described there, in addition to supplying the nitrogen and optionally carbon atoms needed for nitriding and carbonitriding, these vapors also are capable of activating the workpiece surfaces for these low temperature surface hardening processes even though these surfaces may carry a Beilby layer due to a previous metal-shaping operation. As a result, this self-activating surface hardening technology can be directly used on these workpieces, even though they define complex shapes due to previous metal-shaping operations and even though they have not been pretreated to remove their Beilby layers first.

Kinetics of Low Temperature Carburization

Once the workpiece is ready for carburization, it is contacted with a carburizing gas at elevated temperature for a time sufficient to allow carbon atoms to diffuse into the workpiece surfaces.

In low temperature carburization, the carburizing gas is maintained at an elevated carburizing temperature which is high enough to promote diffusion of carbon atoms into the surfaces of the article but not so high that carbide precipitates form to any significant degree.

This may be more readily understood by reference to FIG. 1 which is Time-Temperature-Transformation (TTT) phase diagram of an AISI 316 stainless steel [316SS (UNS S31600)] illustrating the conditions of time and temperature under which carbide precipitates form when the steel is carburized using a particular carburization gas. In particular, FIG. 1 shows, for example, that if the workpiece is heated within the envelope defined by Curve A, a metal carbide of the formula M23C6 will form. Thus, it will be appreciated that if the workpiece is heated under conditions of time and temperature falling anywhere above the lower half of Curve A, carbide precipitates will form in the workpiece surfaces. Therefore, low temperature carburization is carried out below curve A so that carbide precipitates do not form.

From FIG. 1 it can also be seen that, for a given carburizing gas, the carburization temperatures which promote formation of carbide precipitates vary as function of carburizing time. For example, FIG. 1 shows that at a carburization temperature of 1350° F., carbide precipitates begin forming after only one-tenth of an hour (6 minutes). On the other hand, at a carburization temperature of about 975° F., carbide precipitates do not begin forming until carburization has proceeded for 100 hours or so. Because of this phenomenon, low temperature carburization is normally carried out at a constant carburization temperature maintained below the temperature at which carbide precipitates form at the end of carburization. For example, for a low temperature carburization process anticipated to last 100 hours using the alloy and carburizing gas of FIG. 1, carburization would normally be carried out at a constant temperature of 925° F. or less, since this would maintain the workpiece safely below the temperature at which carbide precipitates form at the endpoint of carburization (i.e. 975° F.). Or, as illustrated in FIG. 1, carburization would normally be done along line M, since this would keep the workpiece safely below point Q, so that carbide precipitates do not form.

Low temperature carburization processes can take 50 to 100 to 1000 hours or more to achieve the desired amount of carburization. Accordingly, it will be appreciated that when carburization is carried out at a constant temperature safely below point Q, the carburization temperature at any instantaneous time, t, during earlier phases of carburization will be far below Curve A. This is also illustrated in FIG. 1 in which line segment S represents the difference between the temperature of Curve A and the carburization temperature (925° F.) at the endpoint of carburization, while line segment T represents this difference one hour after carburization has begun. As can be seen by comparing line segments S and T, when the carburization temperature is maintained at a constant 925° F. so as to be at least 50° F. below point Q at the end of carburization, then there will be a 150° F. difference (1175° F.-925° F.) between the actual carburization temperature and Curve A one hour after carburization has begun. Since carburization rate depends on temperature, it can be seen that the relatively low carburization temperature of 925° F. during the early phases of carburization slows the overall carburization process carried out in this manner.

Adjustment of Carburization Temperature

As discussed in U.S. Pat. No. 6,547,888, this constraint can be largely eliminated by beginning the carburization process with a higher carburization temperature than typically used in the past and then lowering this temperature as carburization proceeds to reach a carburization temperature safely below the envelope defined by the curve in the phase diagram of the workpiece at the endpoint of the carburization process.

This approach is illustrated by Curve X in FIG. 2,[1] which is similar to Curve M in FIG. 1, except that Curve X illustrates lowering the carburization temperature over the course of carburization from an initial high value to a lower final value. In particular Curve X shows starting carburization at an initial carburization temperature of 1125° F. which is about 50° F. less than the temperature at which carbide precipitates begin to form one-half hour into the carburization process (Point W of FIG. 2), and then lowering the carburization temperature as carburization proceeds to reach a final carburization temperature of 925° F. at the endpoint of carburization, the same endpoint temperature used in the conventional process as illustrated in FIG. 1.

[1] Note that FIG. 2 is the same TTT diagram as FIG. 1.

Carburization temperature at any time t during the carburization process is kept within a predetermined amount (e.g., 50° F., 75° F., 100° F., 150° F. or even 200° F.) of the temperature at which carbides just begin to form at that time. In other words, the carburization temperature is maintained below Curve A by a predetermined temperature amount (e.g., a temperature buffer) throughout the carburization process. By this means, the carburization temperature is kept considerably higher than in conventional single, low-temperature practice yet below the temperatures at which carbide precipitates begin to form. The net effect of this approach is to increase the overall rate of carburization because, throughout most of the carburization process, the carburization temperature is higher than it would otherwise be. At any time t during carburization, the instantaneous rate of carburization depends on temperature, and in this approach, increases this instantaneous rate by increasing the instantaneous carburization temperature. The net effect is a higher overall rate of carburization, which in turn leads to a shorter overall amount of time for completing the carburization process.

Of course, it is still necessary when operating at higher carburization temperatures as described above to insure that carbide precipitates do not form to any substantial degree during carburization. Accordingly, not only is the carburization temperature set so as not to drop below a minimum predetermined amount at any time t, as described above, but it is also set not to exceed a maximum value which is too close to Curve A. In other words, the carburization temperature must still be maintained a sufficient amount (e.g. 25° F. or 50° F.) below Curve A at any time t to insure that carbide precipitates are not formed. In actual practice, this means that the carburization temperature will be set within a range below Curve A whose maximum is a sufficient distance below Curve A (e.g., 25° F. or 50° F.) and whose minimum is further below Curve A by the predetermined amount mentioned above (i.e. 50° F. 75° F., 100° F., 150° F. or 200° F., for example). Thus, the carburization temperature can be set to reside within some suitable range (e.g. 25° F. to 200° F. or 50° F. to 100° F.) below Curve A.

Curve Y in FIG. 3[2] shows another way this can be carried out similarly as described above, except that the carburization temperature is lowered in steps rather than continuously. Incremental reductions may be simpler in many instances, especially from an equipment standpoint. Because carburization processes can take a few to many hours, the number of increments can vary from as few as three to five to as many as 10, 15, 20, 25 or even more.

[2] Note that FIG. 3 is the same TTT diagram as FIGS. 1 and 2.

Need for Faster Surface Treatment

Hardening by many of the methods described above can be time consuming. Many of the traditional methods require hours, or even days, to achieve useful hardness levels and a substantial case depth on order of tens of microns. Therefore, it would be advantageous to develop a method that achieves hardening levels and depths of the methods of the prior art in less time and expense.

SUMMARY

A method for treating a workpiece made from a self-passivating metal and having a Beilby layer is disclosed. The method comprises exposing the workpiece to the vapors produced by heating a reagent having a guanidine [$HNC(NH_2)_2$] moiety and complexed with HCl to activate the workpiece for low temperature interstitial surface hardening.

A method for producing a case-hardened component in continuous conveyer belt production is disclosed. The method comprises purging an atmosphere of the continuous conveyer belt with gas, while maintaining the atmosphere at a temperature of 600° C. or less, placing an untreated component on the continuous conveyer belt, applying the reagent by vapor, solvent or with a vehicle to carry the reagent, such as a coating the untreated component to a reagent having a guanidine [$HNC(NH_2)_2$] moiety and complexed with HCl to activate the component, exposing the workpiece to the vapors produced by heating the reagent to activate the workpiece for low temperature interstitial surface hardening and performing the low temperature interstitial surface hardening on the component over a period of less than 2 hours.

A method for treating a workpiece made from a self-passivating metal and having a Beilby layer is disclosed. The method comprises exposing the workpiece, at an exposing temperature below a temperature at which nitride and/or carbide precipitates form in the workpiece, to vapors produced by heating one or more non-polymeric N/C/H compounds to activate the workpiece for low temperature interstitial surface hardening. The one or more N/C/H compounds: (a) is solid or liquid at 25° C. and atmospheric pressure, (b) has a molecular weight of ≤5,000 Daltons, and (c) can be either uncomplexed or complexed with a hydrohalide acid. If the non-polymeric N/C/H compound is uncomplexed, any halogen atoms replace one or more labile hydrogen atoms of the non-polymeric N/C/H compound. If the non-polymeric N/C/H compound is complexed, any halogen atoms form a part of the hydrohalide complexing acid.

BRIEF DESCRIPTION OF DRAWINGS

FIG. 6(*b*) is an Auger depth profile of a case-hardened stainless steel (316SS (UNS S31600)) pan 1 showing the overlapping carbon and nitrogen concentrations in the surface layer in the presence of Guanidine HCl (GuHCl).

DETAILED DESCRIPTION

Definitions and Terminology

Figure 1:
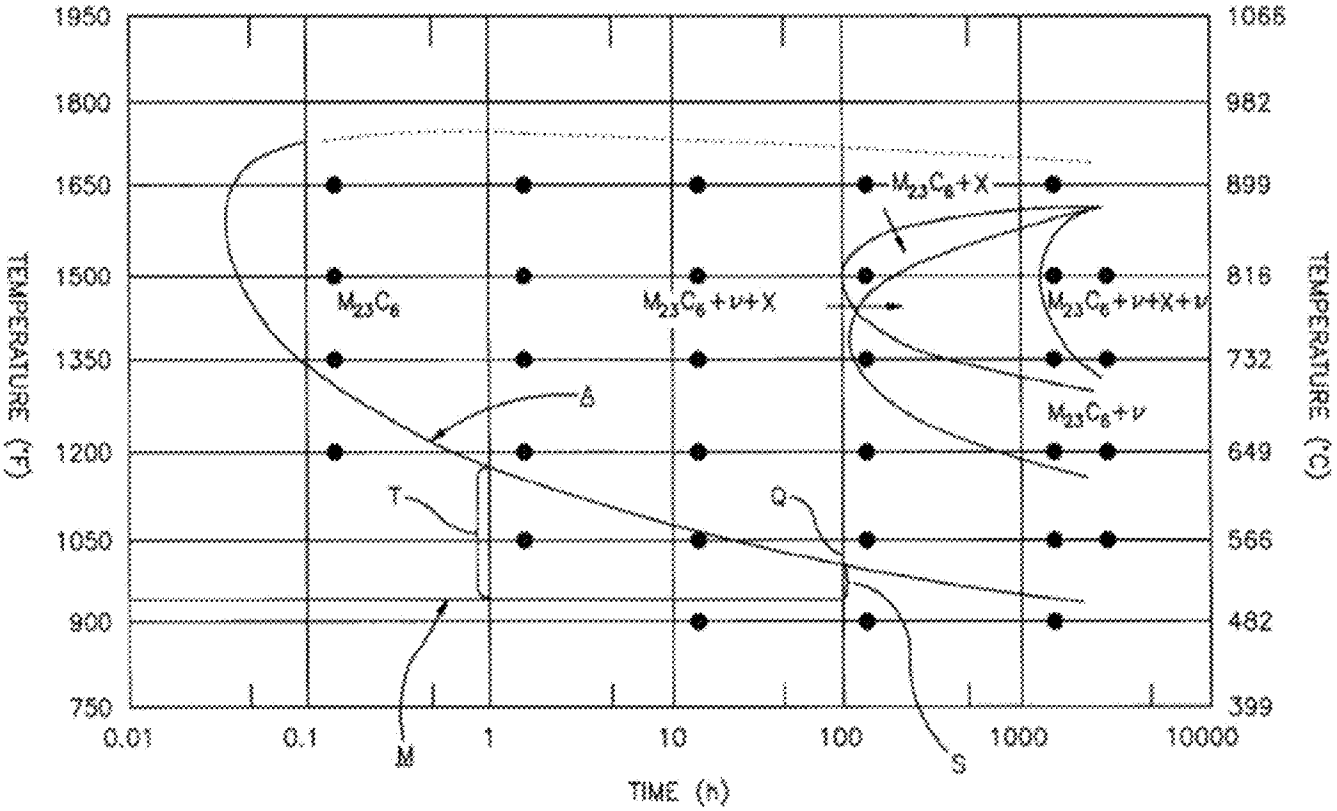
FIG. 1 is a Time-Temperature-Transformation (TTT) phase diagram of an AISI 316 stainless steel [316SS (UNS S31600)].

As indicated above, the fundamental difference between traditional (high temperature) surface hardening and the newer low temperature surface hardening processes first developed in the mid 1980's is that, in traditional (high temperature) surface hardening, hardening occurs as a result of the formation of carbide and/or nitride precipitates in the surfaces of the metal being hardened. In contrast, in low temperature surface hardening, hardening occurs as a result of the stress placed on the crystal lattice of the metal at the surfaces of the metal as a result of the carbon and/or nitrogen atoms which have diffused into these surfaces. Because the carbide and/or nitride precipitates responsible for surface hardening in traditional (high temperature) surface hardening are not found in stainless steels surface hardened by low temperature carburization, and further because low temperature surface hardening does not adversely affect the corrosion resistance of stainless steels, original thinking was that surface hardening occurs in low temperature carburization solely as a result of the sharply localized stress fields generated by interstitially dissolved carbon and/or nitrogen atoms which have diffused into the (austenitic) crystal structure of the steel.

However, recent more sophisticated analytical work has revealed that when low temperature surface hardening is carried out on alloys in which some or all of the alloy volume consists of ferritic phases, some type of previously-unknown nitride and/or carbide precipitate may form in small amounts in these ferritic phases. Specifically, recent analytical work suggests that in AISI 400 series stainless steels, which generally exhibit a ferrite phase structure, small amounts of previously unknown nitrides and/or carbides may precipitate when the alloy is low-temperature surface hardened. Similarly, recent analytical work suggests that in duplex stainless steels, which contain both ferrite and austenite phases, small amounts of previously unknown nitrides and/or carbides may precipitate in the ferrite phases of these steels when they are low temperature surface hardened. While the exact nature of these previously unknown, newly discovered nitride and/or carbide precipitates is still unknown, it is known that the ferrite matrix immediately surrounding these "para-equilibrium" precipitates is not depleted in its chromium content. The result is that the corrosion resistance of these stainless steels remains unimpaired, because the chromium responsible for corrosion resistance remains uniformly distributed throughout the metal.

Accordingly, for the purposes of this disclosure, it will be understood that when reference is made to a workpiece surface layer which is "essentially free of nitride and/or carbide precipitates," or to a workpiece which is surface hardened "without formation of nitride and/or carbide precipitates," or to a "temperature which is below a temperature at which nitride and/or carbide precipitates form," this reference refers to the type of nitride and/or carbide precipitates which are responsible for surface hardening in traditional (high temperature) surface hardening processes, which precipitates contain enough chromium so that the metal matrix immediately surrounding these precipitates loses its corrosion resistance as a result of being depleted in its chromium content. This reference does not refer to the previously-unknown, newly-discovered nitride and/or carbide precipitates disclosed herein which may form in small amounts in the ferrite phases of AISI 400 stainless steels, duplex stainless steels and other similar alloys.

Also, it should be understood that, for the purposes of this disclosure, "carbonitriding," "nitrocarburizing" and "nitrocarburization" refer to the same process.

In addition, "self-passivating" as used in this disclosure in connection with referring to the alloys which are processed by this invention will be understood to refer to the type of alloy which, upon exposure to air, rapidly forms a protective oxide coating which is impervious to the transmission of water vapor, oxygen and other chemicals. Thus, metals such as iron and low alloy steels which may form iron oxide coatings upon exposure to air are not considered to be "self-passivating" within the meaning of this term because these coatings are not impervious to the transmission of water vapor, oxygen and other chemicals.

Alloys

This invention can be carried out on any metal or metal alloy which is self-passivating in the sense of forming a coherent protective chromium-rich oxide layer upon exposure to air which is impervious to the passage of nitrogen and carbon atoms. These metals and alloys are well known and described for example in earlier patents that are directed to low temperature surface hardening processes, examples of which include U.S. Pat. Nos. 5,792,282, 6,093,303, 6,547,888, EPO 0787817 and Japanese Patent Document 9-14019 (Kokai 9-268364).

Alloys of special interest are the stainless steels, i.e., steels containing 5 to 50, preferably 10 to 40, wt. % Ni and enough chromium to form a protective layer of chromium oxide on the surface when the steel is exposed to air. That includes alloys with about 10% or more chromium. Preferred stainless steels contain 10 to 40 wt. % Ni and 10 to 35 wt. % Cr. More preferred are the AISI 300 series steels such as AISI 301, 303, 304, 309, 310, 316, 316L, 317, 317L, 321, 347, CF8M, CF3M, 254SMO, A286 and AL6XN stainless steels. The AISI 400 series stainless steels and especially Alloy 410, Alloy 416 and Alloy 440C are also of special interest.

Other types of alloys that can be processed by this invention are the nickel-based, cobalt based and manganese-based alloys which also contain enough chromium to form a coherent protective chromium oxide protective coating when the steel is exposed to air, e.g., about 10% or more chromium. Examples of such nickel-based alloys include Alloy 600, Alloy 625, Alloy 825, Alloy C-22, Alloy C-276, Alloy 20 Cb and Alloy 718, to name a few. Examples of such cobalt-based alloys include MP35N and Biodur CMM. Examples of such manganese-based alloys include AISI 201, AISI 203EZ and Biodur 108.

Still another type of alloy on which this invention can be carried out are the titanium-based alloys. As well understood in metallurgy, these alloys form coherent protective titanium oxide coatings upon exposure to air which are also impervious to the passage of nitrogen and carbon atoms. Specific examples of such titanium-based alloys include Grade 2, Grade 4 and Ti 6-4 (Grade 5). In the same way, alloys based on other self-passivating metals such as zinc, copper and aluminum can also be activated (depassivated) by the technology of this invention.

The particular phase of the metal being processed in accordance with the present invention is unimportant in the sense that this invention can be practiced on metals of any phase structure including, but not limited to, austenite, ferrite, martensite, duplex metals (e.g., austenite/ferrite), etc.

Activating with a Non-Polymeric N/C/H Compound

In accordance with this invention, workpieces which are made from self-passivating metals and which carry a Beilby layer on at least one surface region thereof are activated (i.e., depassivated) for low temperature surface hardening by contacting the workpiece with the vapors produced by heating (pyrolyzing) a reagent comprising non-polymeric N/C/H compound. Mixtures of different non-polymeric N/H/C compounds can also be used for this purpose. As further discussed below, in addition to causing depassivation of the workpiece, the non-polymeric N/H/C compounds of this invention can also supply nitrogen and carbon atoms for simultaneous surface hardening, e.g., carburization, nitriding, and/or carbonitriding of the workpiece. Since different non-polymeric N/C/H compounds supply these nitrogen and carbon atoms in different amounts and degrees, mixtures of these compounds can be used to tailor that the particular non-polymeric N/C/H compounds used to the particular operating conditions desired for simultaneous surface hardening.

The non-polymeric N/C/H compounds of this invention can be described as any compound which (a) contains at least one carbon atom, (b) contains at least one nitrogen atom, (c) contains only carbon, nitrogen, hydrogen and optionally halogen atoms, (d) is solid or liquid at room temperature (25° C.) and atmospheric pressure, and (e) has a molecular weight of ≤5,000 Daltons. Non-polymeric N/C/H compounds with molecular weights of ≤2,000 Daltons. ≤1,000 Daltons or even ≤500 Daltons are included. Non-polymeric N/C/H compounds which contain a total of 4-50 C+N atoms, 5-50 C+N atoms, 6-30 C+N atoms, 6-25 C+N atoms, 6-20 C+N atoms, 6-15 C+N atoms, and even 6-12 C+N atoms, are included.

Specific classes of non-polymeric N/C/H compounds that can be used in this invention include primary amines, secondary amines, tertiary amines, azo compounds, heterocyclic compounds, ammonium compounds, azides and nitriles. Of these, those which contain 4-50 C+N atoms are desirable. Those which contain 4-50 C+N atoms, alternating C═N bonds and one or more primary amine groups are included. Examples include melamine, aminobenzimidazole, adenine, benzimidazole, guanidine, biguanide, triguanide, pyrazole, cyanamide, dicyandiamide, imidazole, 2,4-diamino-6-phenyl-1,3,5-triazine (benzoguanamine), 6-methyl-1,3,5-triazine-2,4-diamine (acetoguanamine). 3-amino-5,6-dimethyl-1,2,4-triazine, 3-amino-1,2,4-triazine, 2-(aminomethyl)pyridine, 4-(aminomethyl)pyridine, 2-amino-6-methylpyridine and 1H-1,2,3-triazolo(4,5-b) pyridine, 1,10-phenanthroline, 2,2'-bipyridyl and (2-(2-pyridyl)benzimidazole). Specific triguanides include 1,3-bis (diaminomethylidene)guanidine and N-carbamimidoylimidodicarbonimidic diamide.

Also included are the three triazine isomers, as well as various aromatic primary amines containing 4-50 C+N atoms such as 4-methylbenzeneamine (p-toluidine), 2-methylaniline (o-toluidine), 3-methylaniline (m-toluidine), 2-aminobiphenyl, 3-aminobiphenyl, 4-aminobiphenyl, 1-naphthylamine, 2-naphthylamine, 2-aminoimidazole, and 5-aminoimidazole-4-carbonitrile. Also included are aromatic diamines containing 4-50 C+N atoms such as 4,4'-methylene-bis(2-methylaniline), benzidine, 4,4'-diaminodiphenylmethane, 1,5-diaminonaphthalene, 1,8-diaminonaphthalene, and 2,3-diaminonaphthalene. Hexamethylenetetramine, benzotriazole and ethylene diamine are also of interest.

Yet another included class of compounds, in which some of the above compounds are included, are those which form nitrogen-based chelating ligands, i.e., polydentate ligands containing two or more nitrogen atoms arranged to form separate coordinate bonds with a single central metal atom. Compounds forming bidentate chelating ligands of this type are included. Examples include o-phenantrolin, 2,2'-bipyridine, aminobenzimidazol and guanidinium chloride (guanidinium chloride being further discussed below).

Still another included type of non-polymeric N/C/H compounds are those used to produce carbon nitrides and/or carbon nitride intermediate(s) described in WO 2016/027042, the disclosure of which is incorporated herein in its entirety. The intermediate species may participate in or contribute to the low-temperature activation and hardening of the work piece. Precursors, which can include melamine and GuHCl, can form various carbon nitride species. These species, which have the empirical formula C3N4, comprises stacked layers or sheets one atom thick, which layers are formed from carbon nitride in which there are three carbon atoms for every four nitrogen atoms. Solids containing as little as 3 such layers and as many as 1000 or more layers are possible. Although carbon nitrides are made with no other elements being present, doping with other elements is contemplated.

Yet another included subgroup of non-polymeric N/C/H compounds described above are those which contain 20 or less C+N atoms and at least 2 N atoms.

In some instances, at least 2 of the N atoms in these compounds are not primary amines connected to a 6-carbon aromatic ring, either directly or through an intermediate aliphatic moiety. In other words, although one or more of the N atoms in these particular non-polymeric N/C/H compounds can be primary amines connected to a 6-carbon aromatic ring, at least two of the N atoms in these compound should be in a different form, e.g., a secondary or tertiary amine or a primary amine connected to something other than a 6-carbon aromatic ring.

The N atoms in the non-polymeric N/C/H compounds of this subgroup (i.e., non-polymeric N/C/H compounds containing 20 or less C+N atoms and at least 2 N atoms) can be directly connected to one another such as occurs in an azole moiety, but more commonly will be connected to one another by means of one or more intermediate carbon atoms.

Of the non-polymeric N/C/H compounds of this subgroup, those which contain 15 or less C+N atoms, as well as those which contain at least 3 N atoms are included. Those that contain 15 or less C+N atoms and at least 3 N atoms are included.

The non-polymeric N/C/H compounds of this subgroup can be regarded as having a relatively high degree of nitrogen substitution. In this context, a relatively high degree of nitrogen substitution will be regarded as meaning the N/C atomic ratio of the compound is at least 0.2. Compounds with N/C atomic ratios of 0.33 or more, 0.5 or more, 0.66 or more, 1 or more, 1.33 or more, or even 2 or more are included. Non-polymeric N/C/H compounds with N/C atom ratios of 0.25-4, 0.3-3, 0.33-2, and even 0.5-1.33 are included.

Non-polymeric N/C/H compounds of this subgroup containing 10 or less C+N atoms are included, especially those in which the N/C atomic ratio is 0.33-2, and even 0.5-1.33.

Non-polymeric N/C/H compounds of this subgroup which contain 8 or less C+N atoms are of special interest, especially those in which the N/C atomic ratio is 0.5-2 or even 0.66-1.5, in particular triguanide-based reagents.

In order to achieve this relatively high degree of nitrogen substitution, the non-polymeric N/C/H compounds of this subgroup can include one or more nitrogen-rich moieties examples of which include imine moieties [C═NR], cyano moieties [–CN] and azo moieties [R—N═N—R]. These moieties can be a part of a 5- or 6-membered heterocyclic ring containing one or more additional N atoms such as occurs when an imine moiety forms a part of an imidazole or triazine group or when an azole moiety forms a part of a triazine or triazole group.

These moieties can also be independent in the sense of not being part of a larger heterocyclic group. If so, two or more of these moieties can be connected to one another through an intermediate C and/or N atom such as occurs, for example, when multiple imine moieties are connected to one another by an intermediate N atom such as occurs in 1,1-dimethylbiguanide hydrochloride or when a cyano group is connected to an imine moiety through an intermediate N atom such as occurs in 2-cyanoguanidine. Alternatively, they can simply be pendant from the remainder of the molecule such as occurs in 5-aminoimidazole-4-carbonitrile or they can be directly attached to a primary amine such as occurs in 1,1-dimethylbiguanide hydrochloride, formamidine hydrochloride, acetamidine hydrochloride, 2-cyanoguanidine, cyanamide and cyanoguanidine monohydrochloride.

As indicated above, if the non-polymeric N/C/H compounds of this subgroup contains one or more primary amines, these primary amines are preferably not connected to the carbon atom of a 6-carbon aromatic ring. Rather, they are preferably connected to something else such as, for example, to the carbon atom of an imine moiety [C═NR] such as occurs in 1,1-dimethylbiguanide hydrochloride, formamidine hydrochloride, acetamidine hydrochloride, 2-cyanoguanidine, cyanamide and cyanoguanidine monohydrochloride. Or, the primary amine can be connected, directly or indirectly, to a heterocyclic moiety containing at least one and preferably at least two additional N atoms such as occurs, for example, in 2-aminobenzimidazole, 2-aminomethyl benzimidazole dihydrochloride, 5-aminoimidazole-4-carbonitrile, and 3-amino-1,2,4-triazine.

In the non-polymeric N/C/H compounds of this subgroup which contain one or more secondary amines, the secondary amine can be part of a heterocyclic ring containing an additional 0, 1 or 2 N atoms. An example of such compounds in which the secondary amine is part of a heterocyclic ring containing no additional N atoms is 1-(4-piperidyl)-1H-1,2,3-benzotriazole hydrochloride. Examples of such compounds in which the heterocyclic ring contains one additional N atom are 2-aminobenzimidazole, 2-aminomethyl benzimidazole dihydrochloride, imidazole hydrochloride and 5-aminoimidazole-4-carbonitrile. An example of such compounds in which the secondary amine is part of a heterocyclic ring containing two additional N atoms is benzotriazole. Alternatively, the secondary amine can be connected to a cyano moiety such as occurs in 2-cyanoguanidine and cyanoguanidine monohydrochloride.

In the non-polymeric N/C/H compounds of this subgroup which contain one or more tertiary amines, the tertiary amine can be part of a heterocyclic ring containing an additional 1 or 2 N atoms, an example of which is 1-(4-piperidyl)-1H-1,2,3-benzotriazole hydrochloride.

In some embodiments of the invention, the non-polymeric N/C/H compound used will contain only N, C and H atoms. In other words, the particular non-polymeric N/C/H compound used will be halogen-free. In other embodiments of the invention, the non-polymeric N/C/H compound can contain or be associated or complexed with one or more optional halogen atoms.

One way this can be done is by including a hydrohalide acid such as HCl in the compound in the form of an association or complex. If so, this non-polymeric N/C/H compounds is referred to in this disclosure as being "complexed." On the other hand, if the non-polymeric N/C/H compound has not been complexed with such an acid, then it is referred to in this disclosure as being "uncomplexed." In those instances in which neither "complexed" nor "uncomplexed" is used, it will be understood that the term in question refers to both complexed and uncomplexed non-polymeric N/C/H compounds.

Another way an optional halogen atom can be included in the non-polymeric N/C/H compounds of this invention is by replacing some or all of its labile hydrogen atoms with a halogen atom, preferably Cl, F or both. For ease of description, uncomplexed non-polymeric N/C/H compounds of this subgroup which contain one or more halogen atoms substituting a liable H atom are referred to herein as "halogen-substituted," while uncomplexed non-polymeric N/C/H compounds of this invention which are free of such halogen atoms are referred to herein as "unsubstituted."

In those embodiments of this invention in which the non-polymeric N/C/H compounds used contain optional halogen atoms, all of the non-polymeric N/C/H compounds used can contain optional halogen atoms. In addition, both types of halogen-containing non-polymeric N/C/H compounds can be used, i.e., complexed non-polymeric N/C/H compounds in which the halogen atom is part of the complexing hydrohalide acid and uncomplexed non-polymeric N/C/H compounds in which the halogen atom replaces a labile H atom.

As indicated above, the non-polymeric N/C/H compounds of this invention can be complexed with a suitable hydrohalide acid such as HCl and the like (e.g., HF, HBr and HI), if desired. In this context, "complexing" will be understood to mean the type of association that occurs when a simple hydrohalide acid such as HCl is combined with a nitrogen-rich organic compound such as 2-aminobenzimidazole. Although the HCl may dissociate when both are dissolved in water, the 2-aminobenzimidazole does not. In addition, when the water evaporates, the solid obtained is composed of a mixture of these individual compounds on an atomic basis—e.g., a complex. It is not composed exclusively of a salt in which Cl— anions from the HCl are ionically bound to N atoms in the 2-amionbenzimidazole which N atoms have been made positive by taking up H+ cations derived from the HCl.

When water evaporates from an aqueous mixture of ammonia and HCl, H+ cations derived from the HCl combine with the N atoms from the ammonia to form positively charged ammonium cations. As water continues to evaporate, Cl— anions from the HCl form ionic bonds with these positively charged ammonium cations. As a result, a new compound is formed, ammonium chloride which is a salt. This same thing does not necessarily happen when non-polymeric N/C/H compounds of this invention are complexed with HCl or other hydrohalide acid because, due to the particular chemical structures of these compounds, the nitrogen atoms in these compounds are less likely to form ionic salt bonds.

For example, non-polymeric N/C/H compounds in which the N atoms are present in the form of secondary or tertiary amines can form complexes with bonding other than exclusively ionic bonding because the vast majority of these N atoms are less capable of taking up and becoming positively charged by H+ cations to the extent necessary to form ionic salt bonds. Therefore, in some embodiments of this invention, the complexed non-polymeric N/C/H compounds preferably include at least two nitrogen atoms which are in the form of secondary and/or tertiary amines.

Similarly, it also seems clear that non-polymeric N/C/H compounds in which at least one N atom is present in an imine moiety (C═NR) also form complexes, And this is especially so if the carbon atom of the imine moiety is directly connected to a nitrogen atom such as occurs in imidazole rings, guanidine and it derivates and acid amidine compounds, e.g., formamidine hydrochloride and acetamide hydrochloride. Therefore, in other embodiments, the acid-complexed non-polymeric N/C/H compounds of this invention preferably include one, two, three or even four imine moieties (C═NR). Compounds in which the carbon atom of one or more these imine moieties is directly connected to an N atom are included.

In accordance with this invention, it has been found that vapors produced by heating and/or pyrolyzing a reagent comprising a non-polymeric N/C/H compound, either complexed with a hydrohalide or not complexed with a hydrohalide, to vaporous form readily activates the surface of self-passivating metals notwithstanding the presence of a significant Beilby layer. In addition, in the vast majority of cases, these vapors also supply nitrogen and carbon atoms for the simultaneous surface hardening of the workpiece. Even more surprisingly, it has also found that surface hardening carried out in this way can be accomplished in much shorter periods of time than possible in the past. For example, while it may take earlier processes for activation followed by low temperature surface hardening 24-48 hours to achieve a suitable case, the inventive process for activation and low temperature surface hardening can achieve a comparable case in two hours or less even as low at one minute, whether surface hardening occurs simultaneously with or subsequent to activation.

Although not wishing to be bound to any theory, it is believed that the vapors of this non-polymeric N/C/H compound decompose by heating and/or pyrolysis either prior to and/or as a result of contact with the workpiece surfaces to yield ionic and/or free-radical decomposition species, which effectively activate the workpiece surfaces. In addition, this decomposition also yields nitrogen and carbon atoms which diffuse into the workpiece surfaces thereby hardening them through low temperature carbonitriding.

It will therefore be appreciated that, when a non-polymeric N/C/H compound is used for activation in accordance with this invention, activation and at least some surface hardening will occur simultaneously in most cases, which may make it is unnecessary to include additional nitrogen- and/or carbon-containing compounds in the system for augmenting the surface hardening process. This is not to say, however, that such additional compounds cannot or should not be included.

In this regard, it should be appreciated that the extent to which a workpiece is surface hardened when activated in accordance with this invention depends on a variety of different factors including the nature of the particular alloy being treated, the particular non-polymeric N/C/H compound being used, and the temperature at which activation occurs. Generally speaking, activation in accordance with this invention may occur at temperatures which are somewhat lower than the temperatures normally involved in low temperature surface hardening. Activation in accordance with this invention may also occur at higher temperatures, e.g., 600° C. and above. In addition, different alloys can differ from one another in terms of the temperatures at which they activate and surface harden. In addition, different non-polymeric N/C/H compounds contain greater or lesser relative amounts of nitrogen and carbon atoms.

That being the case, in some embodiments of the invention a particular alloy may become fully surface hardened at the same time it is activated solely as a result of the nitrogen atoms and carbon atoms liberated from the non-polymeric N/C/H compound. If so, augmenting the surface hardening process by including an additional nitrogen- and/or carbon-containing compound or compounds in the system for supplying additional nitrogen atoms and/or carbon atoms may be unnecessary.

In other embodiments of the invention, however, a particular alloy may not become fully surface hardened solely as a result of the nitrogen atoms and carbon atoms liberated by the non-polymeric N/C/H compound during activation. If so, additional nitrogen- and/or carbon-containing compounds can be included in the system for supplying additional nitrogen atoms and/or carbon atoms for augmenting the surface hardening process. Examples include nitrogen, hydrogen, methane, ethane, ethylene, acetylene, ammonia, methylamine, and mixtures thereof. If so, these additional nitrogen- and/or carbon containing compounds can be supplied to the depassivation (activation) furnace at the same time as depassivation (activation) starts or at any time before depassivation (activation) is completed. It should be understood that this additional nitrogen- and/or carbon-containing compound can be different from the non-polymeric N/C/H compound used for surface hardening, but it can also be the same compound, if desired.

In addition, and/or alternatively to augmenting surface hardening during activation in this way, augmenting surface hardening can be postponed until after activation has been completed by supplying additional nitrogen- and/or carbon-containing compounds only after activation is finished. If so, augmented surface hardening can be carried out in the same reactor or a different reactor than that used for activation.

The amount of a non-polymeric N/C/H compound to use for activating a particular workpiece also depends on many factors including the nature of the alloy being activated, the surface area of the workpiece being treated and the particular a non-polymeric N/C/H compound being used. It can easily be determined by routine experimentation using the following working examples as a guide.

In addition, any reagent described herein may be used simultaneously with reagents disclosed in U.S. Pat. No. 10,214,805.

Finally, note that an important feature of this invention is that its non-polymeric N/C/H compound compounds are oxygen-free. The reason is to avoid generating fugitive oxygen atoms upon reaction of these compounds, which would otherwise occur if these compounds contained oxygen atoms. As indicated above, it is believed that activation occurs in accordance with this invention due to the ionic and/or free-radical decomposition species which are generated when the non-polymeric N/C/H compounds of this invention decompose. It is believed that any such fugitive oxygen atoms would react with and thereby incapacitate these ionic and/or free-radical decomposition species. Indeed, this explains why the processes described in the above-noted Christiansen et al. patent have difficulties when the workpieces being treated carry a Beilby layer, because the N/C compounds actually used there contain significant amounts of oxygen. This problem is avoided in accordance with this invention, because the non-polymeric N/C/H compound compounds being used are oxygen-free.

Any suitable form of any reagent described herein may be used with this disclosure. This includes, powder, liquid, gas and combinations thereof. As used herein, "reagents" includes any substance, including a non-polymeric N/C/H compound or other compounds used in the activation and/or hardening of metal.

Low Temperature Thermal Hardening

As indicated above, in addition to activating the surfaces of self-passivating metals for low temperature nitriding or carbonitriding, the vapors produced by heating a non-polymeric N/C/H compound of this invention can also supply nitrogen and carbon atoms that will achieve at least some thermal hardening of the workpiece by means of these thermal hardening processes, even if no additional reagents are included in the reaction system.

However, if desired, the speed with which low temperature thermal hardening occurs can be increased by including additional nitrogen and/or carbon-containing reagents in the reaction system—in particular, by contacting the workpiece with additional nitrogen containing compounds which are capable of decomposing to yield nitrogen atoms for nitriding, additional carbon-containing compounds which are capable of decomposing to yield carbon atoms for carburization, additional compounds containing both carbon and nitrogen atoms which are capable of decomposing to yield both carbon atoms and nitrogen atoms for carbonitriding, or any combination of these.

These additional nitrogen- and/or carbon-containing compounds can be added to the reaction system any time. For example, they can be added after activation of the workpiece has been completed, or at the same time activation is occurring. Finally, they can also be added before activation begins, although it is believed low temperature surface hardening will be more effective if they are added simultaneously with and/or subsequent to activation.

Activation and thermal hardening may be accomplished in accordance with this invention in a closed system as described for example in commonly-assigned U.S. Pat. No. 10,214,805, i.e., in a reaction vessel which is completely sealed against the entry or exit of any material during the entire course of the activation and thermal hardening process. To ensure that activation and thermal hardening are done properly, it is desirable that a sufficient amount of the vapors of a non-polymeric N/C/H compound contact the surfaces of the workpiece, especially those surface regions which carry significant Beilby layers. Because the non-polymeric N/C/H compound that is used for both activation and thermal hardening in accordance with this invention will often be a particulate solid, an easy way to insure this contact is done properly is by coating or otherwise covering these surfaces with this particulate solid and then sealing the reaction vessel before heating of the workpiece and a non-polymeric N/C/H compound begins. The non-polymeric N/C/H compound can also be dissolved or dispersed in a suitable liquid and then coated onto the workpiece.

These approaches are especially convenient when large batches containing many small workpieces such as ferrules and fitting for conduits and the like are thermally hardened at the same time in the same reaction vessel.

The approach of this invention in which activation and thermal hardening are carried out in a closed system as described above resembles in some respects the technology disclosed in U.S. Pat. No. 3,232,797 to Bessen in which thin steel strip is coated with guanidinium compounds including guanidinium chloride and then heated to decompose the guanidinium compound and nitride the steel strip. However, the thin steel strip being nitrided there is not self-passivating in the sense of forming a strongly-adherent, coherent protective oxide coating which is impervious to the passage of nitrogen and carbon atoms. Accordingly, the technology described there has little relevance to this invention in which stainless steel and other self-passivating metals which are impervious to the passage of nitrogen and carbon atoms are rendered transparent to these atoms by contact with the vapors of a non-polymeric N/C/H compound as part of a low temperature thermal hardening process.

Rapid Hardening Using Guanidine HCl Reagents

In accordance with the present disclosure, the Applicants have determined that a specific reagent class of non-polymeric N/C/H compounds that includes a guanidine [$HNC(NH_2)_2$] moiety or functionality complexed with an HCl demonstrates unexpectedly superior results, including providing suitable activation and simultaneous surface hardening to steels in as low as 1 minute as opposed to 2-48 hours.

In particular, results show that at least three reagents belonging to this system, 1,1-Dimethylbiguanide HCl (hereinafter, "DmbgHCl"):

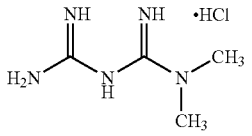

and Guanidine HCl (hereinafter, "GuHCl"):

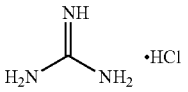

and Biguanide HCl (BgHCl) have successfully induced extremely rapid surface hardening under low temperature conditions. For example, 8 mg of these reagents, tested separately, was able to achieve 20-24 μm of a hardened case depth after 2 hours of low temperature (500° C.) treatment. As in more detail below, this result is considerably faster than using other reagents with similar methods. The hardened case was formed the walls of a cylindrical crucible pan made of 316SS (UNS S31600) stainless steel. An image of an exemplary pan 1 appears in FIG. 4. The pans have a diameter of about 0.5 cm and a height of about 0.5 cm. The pans are machined out of round bar stock using standard metal cutting tools. There were no other significant surface preparations. The machined surfaces of pan 1 likely have a Beilby layer. Testing was conducted using a Netzsch Simultaneous Thermal Analysis (STA) equipment.[3] Pans 1 were case-hardened according to the procedures disclosed in U.S. Pat. No. 10,214,805, with the following modifications:

[3] The Netzsch Simultaneous Thermal Analysis (STA) equipment is described in more detail in "Fourier Transform of Infrared (FT-IR) Spectrometers Coupled to Thermal Analysis: Concepts, Instruments and Applications from RT to 2000° C., Analyzing and Testing," NGB-FTIR-EN-0220-NWS, attached as Exhibit A.

ing the guanidine moiety were have not demonstrated producing ~20 μm case depth in 2 hours or less under similar conditions.

Other compounds including guanidine with HCl are also suitable, e.g., Biguanide HCl (BgHCl) and Melamine HCl (MeHCl). Other suitable guanidine containing compounds include triguanides.[7] More specifically, examples of suitable guanides, biguanides, biguanidines, and triguanides include chlorhexidine and chlorohexidine salts, analogs and derivatives, such as chlorhexidine acetate, chlorhexidine gluconate and chlorhexidine hydrochloride, picloxydine, alexidine and polihexanide. Other examples of guanides, biguanides, biguanidines and triguanides that can be used according to the present invention are chlorproguanil hydrochloride, proguanil hydrochloride (currently used as antimalarial agents), metformin hydrochloride, phenformin and buformin hydrochloride (currently used as antidiabetic agents).

[7] The basic structure of triguanide is as follows:

TABLE 1

| | U.S. Pat. No. 10,214,805 | Hardening of Metal in Pan[4] in the present disclosure |
|---|---|---|
| Equipment providing surface treatment | Clam shell heater. | Netzsch Simultaneous Thermal Analysis (STA) equipment. |
| Reaction vessel conditions | Constant volume (sealed glass vessel). | Constant pressure (reaction vessel vented). |
| Hydration conditions | Not fully dehydrated - exposed to ambient moisture.[5] | Dehydrated.[6] |
| Exposure time | As low as 2 hours. | As low as 1 minute for a 316SS workpiece. |
| Activating reagent | Various | Dimethylbiguanide HC1 (DmbgHC1): 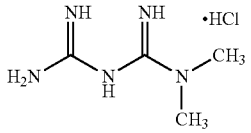 Guanidine HC1 (GuHCl): 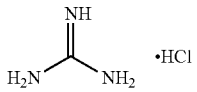 Biguanide HC1 (BgHC1) |

Figure 4:
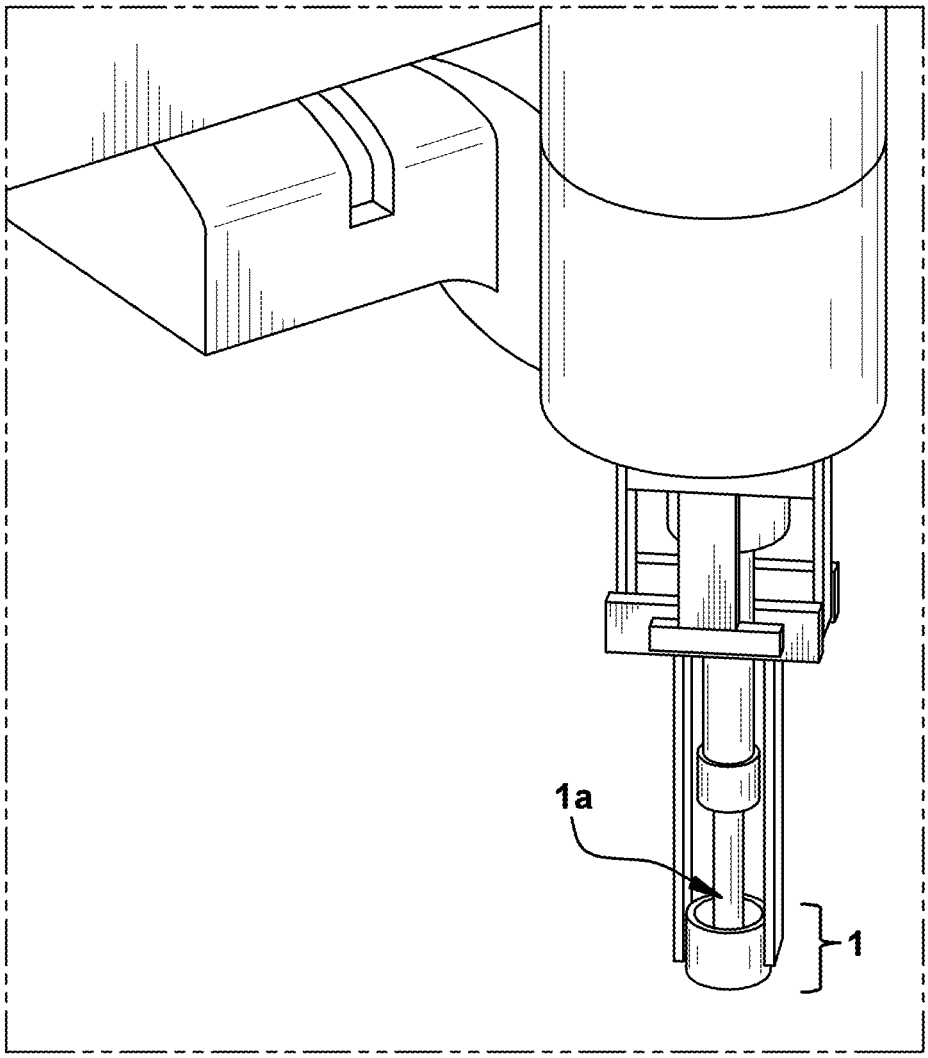
FIG. 4 shows an exemplary pan used in some of the working examples.

[4]E.g., pan 1 in FIG. 4.
[5]Testing showed that moisture reacts and causes chemical changes with various reagents used in U.S. Pat. No. 10,214,805.
[6]Activating reagents placed in pan and heat dehydrated just prior to hardening.

Figure 5:
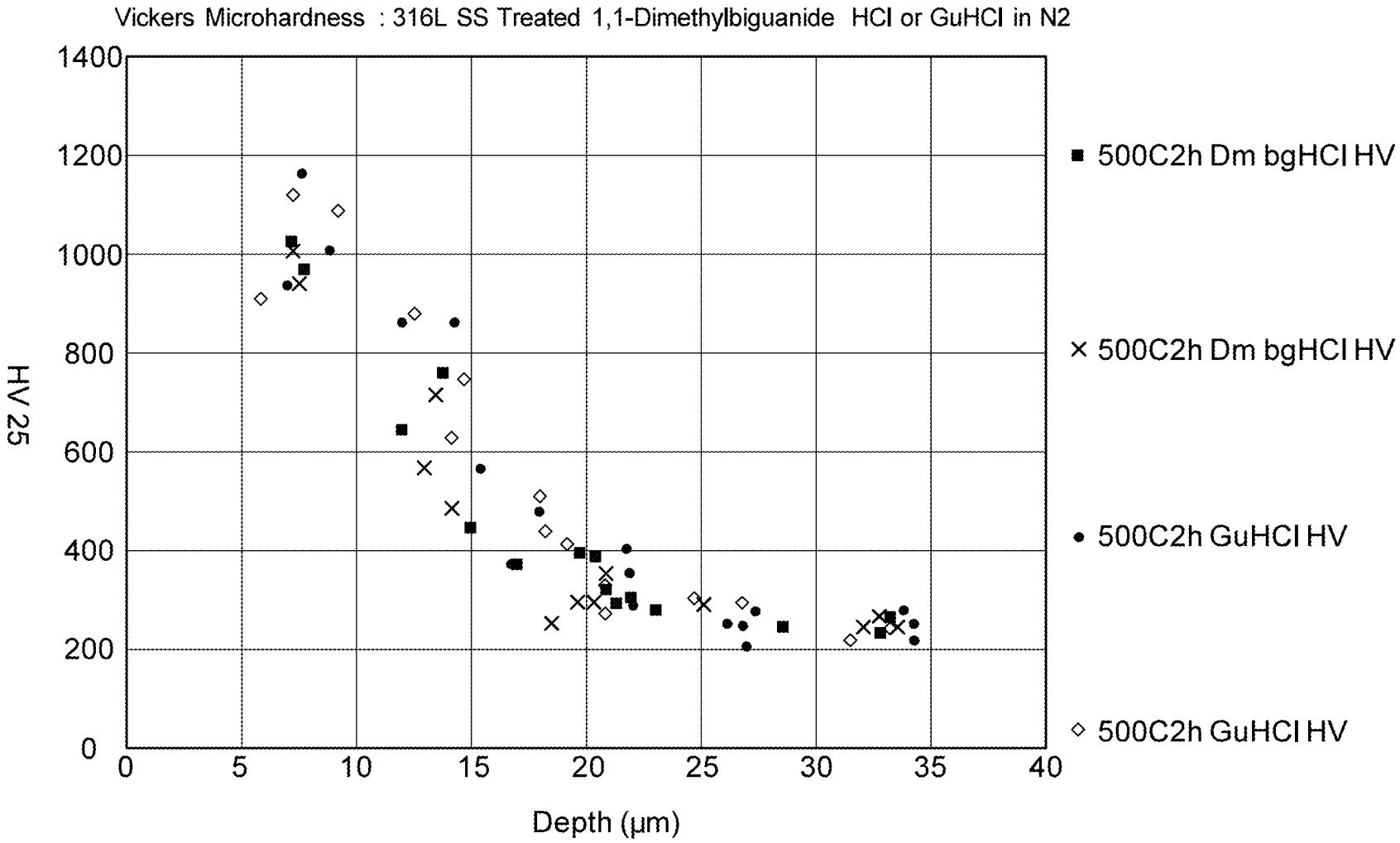
FIG. 5 shows hardness depth profiles, as measured by the Vickers test, for steel treated according to Table 1 with the two different reagents, DmbgHCl and GuHCl.

As shown in Table 1, the Applicants found that these reagents can unexpectedly shorten exposure treatment times from 2 hours to 1 minute with comparable hardening effect. Hardness depth profiles, as measured by the Vickers test, appears in FIG. 5 for steel treated according to Table 1 with the two different reagents, DmbgHCl and GuHCl. These are for 316SS (UNS S31600) stainless steel crucible pans 1 treated according to Table 1 at 500° C. for 2 hours. There were two pans 1 treated with each reagent, DmbgHCl and GuHCl. All samples show improved hardness in the surface region (~20 μm case depth).

The guanidine $[HNC(NH_2)_2]$ moiety or functionality with HCl complexing is the chemical structure common to all of DmbgHCl, GuHCl, and BgHCl. Other reagents tested lack-

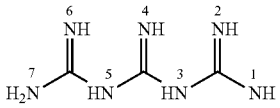

While the results herein discuss using guanidine moiety containing compounds complexed with HCl, these results may also be obtained with guanidine moiety reagents without being complexed with HCl. Reagent complexing with any hydrogen halide may achieve similar results. Guanidine moiety reagents without HCl complexing may also be mixed with other reagents, such as the other reagents discussed in U.S. Pat. No. 10,214,805, having HCl complexing. An important criteria may be whether the reagent or mix of reagents has a liquid phase while decomposing in the temperature ranges of low temperature nitrocarburization (e.g., 450 to 500 C). The extent to which reagents evaporate without decomposing, before reaching that temperature range is an important consideration.

Surface Layer with Overlapping Carbon and Nitrogen

The case hardened surface layer formed in the above tests comprises two separate sublayers characteristic of low temperature nitrocarburization. The outer sublayer is rich with interstitial nitrogen. The inner sublayer is rich with interstitial carbon. Hardness depth profiles show that the case depth represented by these two layers (e.g., 20-24 μm of a hardened case depth) after 2 hours of treatment with DmbgHCl and GuHCl is similar to the case depth achieved in a two-day treatment with more traditional methods and reagents described in U.S. Pat. No. 10,214,805. The Applicants have also discovered a way to harden stainless steel by forming a carbon-containing surface layer, including an overlapping nitrogen concentration in that surface layer. Applicants believe that this overlapping nitrogen and carbon concentration is likely due to the formation of fine precipitates of carbides that do not exhibit the deleterious effects on properties of more coarse-grained precipitates that deplete chromium atoms from nearby base metal (which in turn negatively affects the chromium oxide passivation layer). Therefore, the fine precipitates may also preserve the corrosion resistant, chromium oxide passivation layer on stainless steel (e.g., draw less than 20% of the chromium from that layer). Under conditions of low temperature interstitial hardening,[8] such as those described in U.S. Pat. No. 10,214,805, coarse carbide and nitride precipitates likely do not form. The temperatures are likely too low for the substitutional diffusion of chromium and other metal atoms necessarily for coarse carbides to precipitate. In fact, as described in more detail above, avoiding deleterious coarse carbide and nitride precipitates is one of the reasons for performing hardening under these conditions. Under these same conditions, overlapping concentrations of interstitial nitrogen and carbon are also unlikely. See, e.g., Xiaoting Gu et al., "Numerical Simulations of Carbon and Nitrogen Composition Depth Profiles in Nitrocarburized Austenitic Stainless Steels," Metal. and Mater. Transactions A, 45A, (2014), 4268-4279 (hereinafter, "Gu et al.") incorporated herein by reference. Gu et al. summarizes the thermodynamics behind the physical separating of concentrations of interstitial carbon and nitrogen occurring during low temperature nitrocarburization. See, e.g., Gu et al. at 4268 (Abstract) and 4277. Therefore, Gu et al. strongly suggests against overlapping concentrations of interstitial carbon and nitrogen. Id. However, Gu et al. leaves open the possibility of overlapping nitrogen and carbon concentrations where the elements are not purely interstitial, e.g., tied up in compounds such as nitride or carbide precipitates.

[8]e.g., performing nitrocarburization at temperatures from 450-500° C.

Despite that coarse nitride and carbide precipitates and overlapping interstitial carbon and nitrogen are essentially ruled out by thermodynamics, the Applicants have recently unexpectedly discovered overlapping carbon and nitrogen concentrations in case-hardened layers of stainless steel. The Applicants believe these overlapping concentrations are due to the formation of fine carbide and/or nitride precipitates.

Figure 6A:
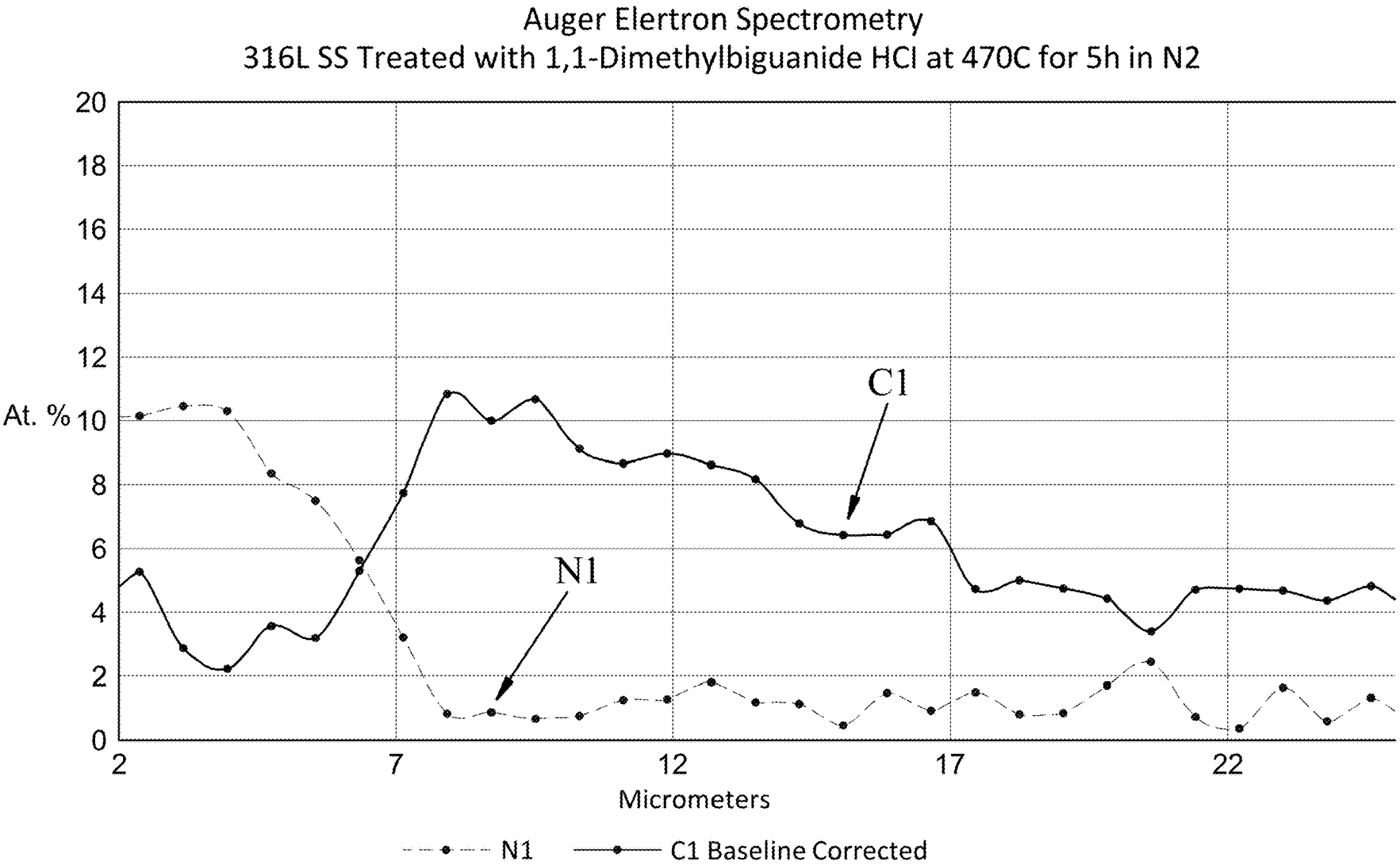
FIG. 6(*a*) is an Auger depth profile of a case-hardened stainless steel (316SS (UNS S31600)) pan 1 showing the overlapping carbon and nitrogen concentrations in the surface layer in the presence of Dimethylbiguanide HCl (DmbgHCl).
Figure 6B:
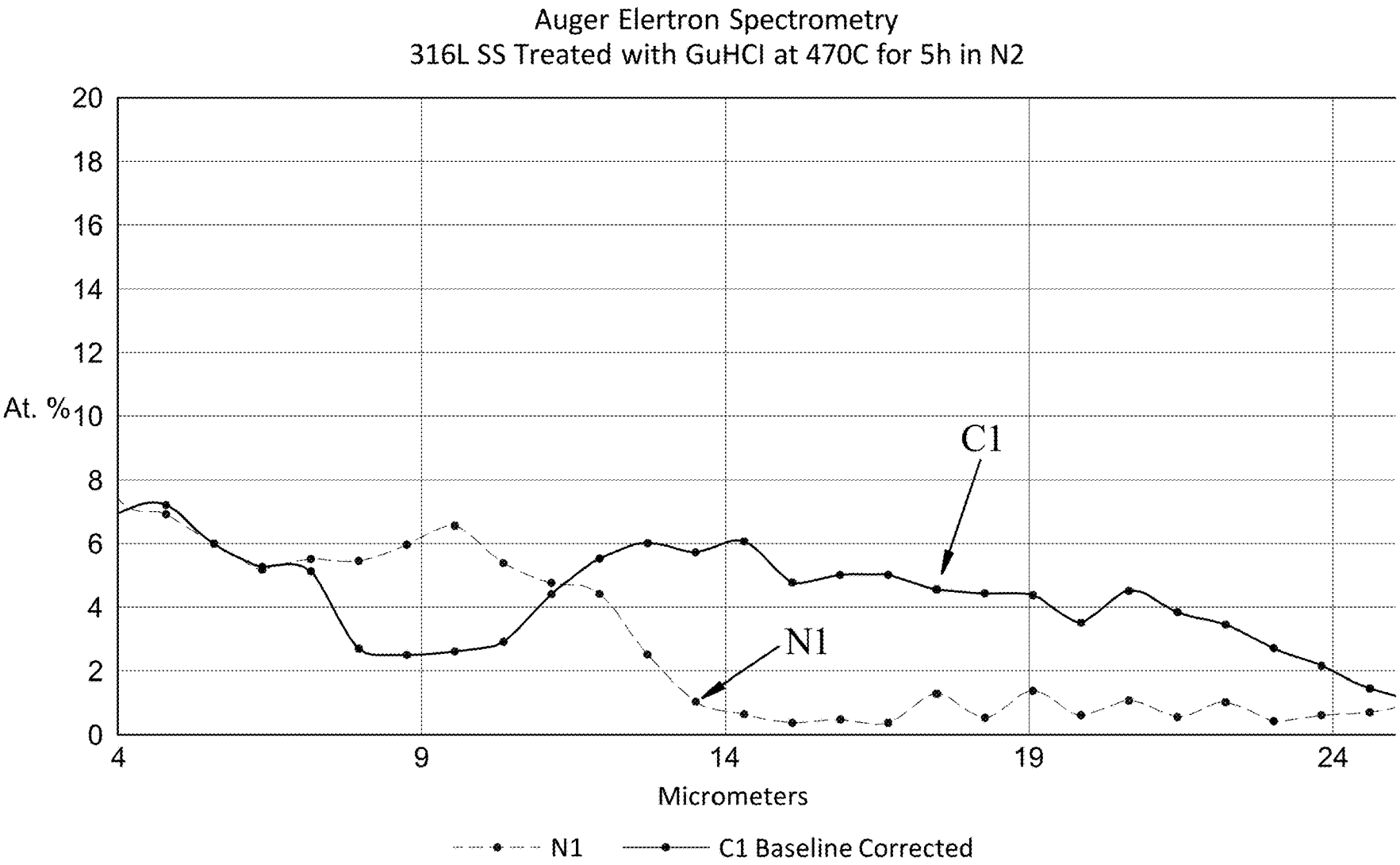

FIGS. 6(*a*) and 6(*b*) are Auger depth profiles of a case-hardened stainless steel (316SS (UNS S31600)) pan 1 showing the overlapping carbon and nitrogen concentrations in the surface layer in the presence of Dimethylbiguanide HCl (DmbgHCl) and Guanidine HCl (GuHCl) reagents, respectively. The x-axes of FIGS. 6(*a*) and 6(*b*) shows depth from the surface in microns. These two scans are of two 316SS crucible pan 1 (see FIG. 4) floors treated according to Table 2 below at 470° C. for 5 hours. They show region of interest nitrogen and carbon results only. FIG. 6(*a*) demonstrates a separation of nitrogen more in the shallow portion (1-2 μm from surface) of the hardened case depth. Carbon has a greater presence in the deeper portion. FIG. 6(*b*) demonstrates not only that nitrogen-carbon separation, but also a second peak of Carbon co-existing with Nitrogen near the surface.

Therefore, FIGS. 6(*a*) and 6(*b*), show a significant concentration of carbon near the surface coincident with nitrogen. FIGS. 6(*a*) and 6(*b*) also show that the surface nitrogen concentration is about 8 to 10% atomic. Carbon concentrations are 5 to 7% atomic. Therefore, FIGS. 6(*a*) and 6(*b*) show that at least some of the carbon is not interstitial and is more likely present in carbide precipitates. The Applicants surmise that such precipitates are likely fine grained because, as discussed above, coarse grained precipitates are unexpected under these low temperature conditions. See discussion of Gu et al. and U.S. Pat. No. 10,214,805 above. Such a surface layer may have a carbon concentration of at least 5 to 15 atomic % and a nitrogen concentration of at least 5 to 15 atomic %.

To generate the samples for FIGS. 6(*a*) and 6(*b*), pans 1 were case-hardened according to the procedures disclosed in U.S. Pat. No. 10,214,805, with the following modifications:

TABLE 2

| | U.S. Pat. No. 10,214,805 | Hardening of Metal in Pan[9] in the present disclosure |
|---|---|---|
| Equipment providing surface treatment | Clam shell heater. | Netzsch Simultaneous Thermal Analysis (STA) equipment. |
| Reaction vessel conditions | Constant volume (sealed glass vessel). | Constant pressure (reaction vessel vented). |
| Hydration conditions | Not fully dehydrated - exposed to ambient moisture.[10] | Dehydrated.[11] |
| Nitrogen and carbon distribution with respect to metal surface according to Auger electron spectroscopy | Distinct separation of nitrogen and carbon distributions:[12] Nitrogen concentrated near the hardened case surface. Carbon concentrated deeper in the case. | Distinct separation and Nitrogen and Carbon co-incident with each other, as shown in FIG 1.[13] |

TABLE 2-continued

| | | |
|---|---|---|
| Exposure time | As low as 2 hours. | As low as 1 minute for a 316SS work piece. |
| Activating reagent | Various | Dimethylbiguanide HC1 (DmbgHC1): 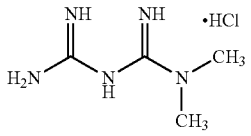 Guanidine HC1 (GuHC1): 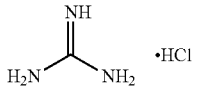 Biguanide HCl (BgHC1) |

[9]E.g., pan 1 in FIG 4.

[10]Testing showed that moisture reacts and causes chemical changes with various reagents used in U.S. Pat. No. 10,214,805.

[11]Activating reagents placed in pan and heat dehydrated just prior to hardening.

[12]This distribution was also visually in cross-sectioned samples.

[13]In contrast with samples from U.S. Pat. No. 10,214,805, no visible distribution was present in cross-sectioned samples. Note that, when samples in this experiment were starved of reagent (1 to 2 mg instead of 8 mg), visible distribution similar to that seen for U.S. Pat. No. 10,214,805 was present. This suggests that a major difference between the reagent in the instant application and in U.S. Pat. No. 10,214,805 is the overall chemical efficacy of reagent (i.e., under instant conditions, the reagent is more effective than under conditions in U.S. Pat. No. 10,214,805).

As shown in Table 2, the Applicants found that these reagents can unexpectedly shorten exposure treatment times from 2 hours to 1 minute with comparable hardening effect. Taken together, the above results suggest that the surface concentration of carbon, coincident with a surface concentration of nitrogen, in FIGS. 6(*a*) and 6(*b*) results from a fine precipitated metal carbides. Apart from that shown in FIGS. 6(*a*) and 6(*b*) and Table 2, there is other evidence supporting this hypothesis. For example, case hardness in the carbide-rich portion of the hardened has been measured to be harder than the hardness of interstitial atom case hardening alone in the absence of such precipitates. In addition, visual inspection of hardened case structures according to instant preparation does not show lath structures typical of more coarse metal carbide and nitride formation. All of this data is consistent with fine metal carbides precipitating during the low temperature reagent induced case hardening described in Table 2.

Fine grained Carbides in 316SS can be expected to have minimal loss of corrosion resistance compared to more coarse carbides. One reason is that, under low temperature conditions of fine carbide formation, minimal chromium migration is expected. This suggests less chromium depletion in the chromium oxide passivation layer providing corrosion resistance to stainless steels. All of this is consistent with a relatively small size of fine carbides (e.g., relatively small volume and mass when compared to coarse carbides). Because of their small size, fine carbides can form with relatively little chromium when compared with coarse grained precipitates. In addition, fine precipitates are not expected to exhibit the deleterious effects on steel properties observed in the case of coarse precipitates. These fine precipitates may exist concurrently with interstitial elemental impurities, such as interstitial nitrogen. In addition, fine nitride precipitates may be present.

Remote Hardening

As described in cited references, reagent activated rapid case hardening of stainless steels (e.g., 316SS stainless steel (UNS S31600)) can be performed when reagent, particularly the guanide-type reagents complexed with HCl of the present disclosure, and workpiece are in relatively close proximity, e.g., separated by distances of 0.1 μm or less. Often, the reagent is directly adjacent to, or even contacting a portion of the steel, during the activation and hardening processes. Some process designers even assume that such close proximity is necessary for rapid hardening.

A treatment that requires the reagent and workpiece to be in close proximity is difficult to scale-up for industrial processes. For example, it is difficult to use a single reagent to activate and harden multiple workpieces. The proximity restriction makes continuous processing (e.g., by conveyer belt) difficult if not impossible. Moreover, since proximity requirements limit the number of workpieces that can be treated by each individual reagent (e.g., one workpiece per one reagent at any given time), reagents may not be used efficiently. In other words, a greater amount of reagent may be needed under such conditions to treat each individual workpiece.

Therefore, it would be advantageous to develop a process of low temperature hardening in which the reagent and steel could be separated. Such a process would allow industrial scale-up and more efficient use of reagent, among other things. In addition, more "remote" hardening may avoid problems resulting from processing at closer reagent/workpiece proximity, including less pitting or disturbances in workpiece surfaces caused by proximity or contact with reagent.

Applicants have discovered that procedures of the present disclosure, particularly when using the guanide-type reagents complexed with HCl of the present disclosure, can be used to remotely harden steel surfaces. That is, it has been discovered that the same or similar case hardening effects described herein can be achieved when the target surfaces for hardening are separated from the activation reagents by distance of 8 inches (20 cm) or more. Recent results have shown that rapid, low temperature, reagent activated hardening can be similarly effective when reagent and workpiece are separated by these distances as they are at close proximity.

In this work, the hardened case was formed the walls of a cylindrical crucible pan made of 316SS (UNS S31600) stainless steel. An image of an exemplary pan 1 appears in FIG. 4. The pans have a diameter of about 0.5 cm and a height of about 0.5 cm. The pans are machined out of round bar stock using standard metal cutting tools. There were no other significant surface preparations. The machined surfaces of pan 1 likely have a Beilby layer. Testing was conducted using a Netzsch Simultaneous Thermal Analysis (STA) equipment.[14]

In these experiments, pans 1 were case-hardened according to the procedures disclosed in U.S. Pat. No. 10,214,805, with the following modifications:

case hardened. Specifically, crucible pans and lids from pan 1 treated for 2-5 hours treatment at 500° C. show 28-32 μm case a reagent/treated surface distance of 0.5 cm. Similar results were obtained for both DmbgHCl, BgHCl, and GuHCl reagents. Moreover, the Applicants discovered that the vapors produced by decomposition of reagent can travel at least 8 inches (20 cm). This case depth in this time period is comparable to contact hardening as described in U.S. Pat. No. 10,214,805 and the other references cited herein. Therefore, the activation and case hardening treatments appear to be just as effective at these distances as they are in close proximity, including direct contact.

The Applicants conclude, based on this data and related observations, that a vapor from decomposing reagent transports to surfaces not in contact with reagent (e.g., crucible pans and lids) and activates and/or hardens those surfaces

TABLE 3

| | U.S. Pat. No. 10,214,805 | Hardening of Metal in Pan[15] in the present disclosure |
|---|---|---|
| Equipment providing surface treatment | Clam shell heater. | Netzsch Simultaneous Thermal Analysis (STA) equipment. |
| Reaction vessel conditions | Constant volume (sealed glass vessel). | Constant pressure (reaction vessel vented). |
| Hydration conditions | Not fully dehydrated - exposed to ambient moisture.[16] | Dehydrated.[17] |
| Exposure time | As low as 2 hours. | As low as 1 minute for a 316SS workpiece. |
| Activating reagent | Various | Dimethylbiguanide HC1 (DmbgHC1): 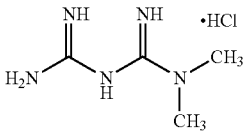 Guanidine HC1 (GuHC1): 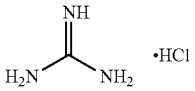 Biguanide HC1 (BgHC1) |

[14]The Netzsch Simultaneous Thermal Analysis (STA) equipment is described in more detail in "Fourier Transform of Infrared (FT-IR) Spectrometers Coupled to Thermal Analysis: Concepts, Instruments and Applications from RT to 2000° C., Analyzing and Testing, "NGB - FTIR - EN 0220 - NWS, attached as Exhibit A.
[15]E.g., pan 1 in FIG. 4.
[16]Testing showed that moisture reacts and causes chemical changes with various reagents used in U.S. Pat. No. 10,214,805.
[17]Activating reagents placed in pan and heat dehydrated just prior to hardening.

As shown in Table 3, the Applicants found that these reagents can unexpectedly shorten exposure treatment times from 2 hours to 1 minute with comparable hardening effect.

As shown in FIG. 4, pan 1 has a hole 1*a* at its top. In the experimental configuration, hole 1*a* is subjected to a nitrogen purge gas at atmospheric pressure. The gas cell is about 8 inches (20 cm) above pan 1. The vapors evolved from the reagent responsible for treatment travel to the gas cell with the analyzer. As discussed below, the Applicants believe that vapors traveling at least this distance, i.e., 8 inches (20 cm), harden the target as quickly and as effectively as when the reagent is placed just adjacent to or in contact with the steel. The Applicants have shown 0.5 cm remote hardening within the crucible pan and lid.

These results show that 316SS metal surfaces not in direct contact with the reagent, and as far away as 8 inches (20 cm) from the reagent, can be effectively activated by reagent and remotely. The Applicants are currently analyzing the composition and properties of this vapor. They discovered that its efficacy relates directly to amount of reagent, e.g., when the reaction system is starved of reagent (less reagent used), less remote activation/hardening is observed.

In one variation, reagent and metal catalyst in the above process may be mixed together in powder form to improve reactivity. More specifically, that metal catalyst could comprise a 316SS or other alloy metal power that is mixed with the reagent. Greater reagent reactivity has been observed when the reagent is mixed with a metal catalyst such as 316SS powder in a ceramic crucible pan versus reagent alone in that ceramic crucible pan.

The above-describe developments have considerable economic impact. They imply that reagent can treat multiple, remote surfaces in parallel (e.g., at the same time) with comparable efficacy as if each were treated serially and in direct contact or close proximity with reagent. For example, remote, rapid, 1 to 2 hour case, and even 1 minute, hardening treatment can be used in continuous conveyer belt production of hardened components. A single reagent (e.g., DmbgHCl, GuHCl, or BgHCl) may be decomposed at a distance from workpieces (e.g., ferrules) as they move on the belt, treating each of them effectively at the same time. This would greatly improve the production volume and rapidity of hardening the workpieces. It would also improve the efficiency of reagent use. Less reagent would be needed per workpiece under such a mass treatment regime than if each workpiece were treated serially in separate reaction vessels.

The Applicants have noticed still other advantages of this process. Remote hardening as described herein avoids some of the problems generated by keeping reagent and treated surface in close proximity. In particular, direct exposure to reagent can cause pitting or other unwanted surface effects. These problems were not observed to result from remote activation and hardening.

Reagent Azeotropes

In addition to the configurations described above, reagents can be combined in various azeotropes. An azeotrope is a mixture of liquids which has a constant boiling point and composition throughout evaporation. The azeotrope evaporation temperature may be near equal to or greater than the boiling points of the pure forms of either of the two liquids in the mixture. Reagent azeotropes may be used in the context of the present disclosure to advantageously combine reagents to enhance or improve reagent properties for use in activation and hardening.

For example, melamine may be combined with a guanide reagent (such as any of the guanide reagents discussed above) in an azeotrope to facilitate use of melamine in certain hardening processes. Melamine, a cyclic Tri-Guanide (without HCl complexing) by its chemical nature assists rapid activation and hardening of the alloys discussed herein. However, in its pure form, melamine can be inconvenient for activation and hardening applications. This is because pure melamine evaporates at a temperature too low to facilitate hardening by some of the processes disclosed herein. Combining melamine with an appropriately chosen liquid in an azeotrope can effectively raise its evaporation temperature. For example, when melamine is mixed with another guanide-like reagent, the mixture may have a greater azeotrope evaporation temperature. This may make the melamine portion of the mix more useful for inducing hardening at appropriate temperatures. The guanide-like reagents that may be used to for azeotropes with melamine include Biguanide HCl, Dimethylbiguanide HCl, Guanidine HCl. Weight proportions may vary. Exemplary melamine to guanide-like weight proportions in the azeotrope include 5% to 95%, 10% to 90%, 25% to 75%, or 50% to 50%. Other compounds may also be included in the reagent or azeotrope mixture as needed. For example, a mixture of melamine and guanide-like reagent may further include an additional regent, or other compounds that may enhance certain properties of the reagent mixture.

Although combining melamine with a guanide-like reagent is discussed above as an exemplary azeotrope, it is to be understood that any suitable combination of the reagents explicitly described herein or included by reference is possible. Melamine may be combined with other reagents. Moreover, mixtures of three or more reagents are also possible, as described above to, for example, facilitate formation of an azeotrope.

Methods for creating a reagent mixture for an azeotrope may include fusing or melting reagents together at a temperature lower than the boiling point of the individual reagents. The melting point of the resultant mixture or azeotrope may be below the melting points of either of the mixed reagents when pure. Alternatively, a reagent mixture for such an azeotrope may be created by suspending the two or more reagents in a solvent, or finely distilled petroleum distillates (e.g., paint). The solvent may then be removed to leave a reagent mixture. For example, one method of removing the solvent would be to evaporate it on a metal or ceramic surface leaving a dry two-reagent mixture.

The above-describe developments have considerable economic impact. The rapid, 1 to 2 hour case hardening treatment can be used in continuous conveyer belt production of hardened workpieces under a nitrogen (or other atmosphere) purge. Reagent (e.g., DmbgHCl and GuHCl) may be sprayed applied directly, or suspended or mixed with a liquid or solid vehicle that may be applied by conventional coating methods such as spray, dip, or vapor directly on workpieces (e.g., ferrules) as they move on the belt. Alternatively, the workpieces can be pretreated with the reagent in some form (coated with a water or oil based coating, powder coated, etc.). This would greatly improve the production volume and rapidity of hardened components.

Tracers

In accordance with yet another feature of this invention, the treating reagents used in this invention—the non-polymeric N/C/H compounds—can be enriched with specific, uncommon isotopes of C, N, H and/or other elements to serve as tracer compounds for diagnostic purposes. For example, a non-polymeric N/C/H compound could be seeded with the same or a different non-polymeric N/C/H compound made with an uncommon isotope of N, C or H, or a completely different compound made with such an uncommon isotope, in low concentration. By using mass spectroscopy or other suitable analytical technique for sensing these tracers, quality control of the low temperature surface hardening processes of this invention on a production scale can be readily determined.

For this purpose, the treating reagent can be enriched with at least one of the following halide isotopes: Ammonium-(15N) Chloride, Ammonium-(15N,D4) Chloride, Ammonium-(D4) Chloride, Guanidine-(13C) Hydrochloride, Guanidine-(15N3) Hydrochloride, Guanidine-(13C, 15N3) Hydrochloride, Guanidine-(D5) Deuteriochloride, and any of their isomers. Alternatively or additionally, the treating reagent can be enriched with at least one of the following non-halide isotopes: Adenine-($^{15}N_2$), p-Toluidine-(phenyl-$^{13}C_6$), Melamine-($^{13}C_3$), Melamine-(Triamine-$^{15}N_3$), Hexamethylenetetramine-(13C6, 15N4), Benzidine-(rings-D8), Triazine(D3), and Melamine-($D_6$), and any of their isomers.

Optional Companion Gases

In addition to the gases mentioned above, the gaseous atmosphere in which activation is accomplished in accordance with this invention can also include one or more other companion gases—i.e., gases which are different from the gaseous compounds mentioned above. For example, this gaseous atmosphere can include inert gases such as argon as shown in the following working examples. In addition, other gases that do not adversely affect the invention activation process in any significant way can also be included, examples of which include hydrogen, nitrogen and unsaturated hydrocarbons such as acetylene and ethylene, for example.

Exposing the Workpiece to Atmospheric Oxygen

In still another embodiment of this invention, the workpiece is exposed to atmospheric oxygen between activation and surface hardening, i.e., after activation of the workpiece has been substantially completed but before low temperature surface hardening has been substantially completed.

As previously indicated, the traditional way in which stainless steel and other self-passivating metals are activated for low temperature carburization and/or carbonitriding is by contacting the workpiece with a halogen containing gas. In this regard, in some of the early work in this area as described in the afore-mentioned U.S. Pat. Nos. 5,556,483, 5,593,510 and 5,792,282, the halogen containing gases used for activation were restricted to fluorine-containing gases which are very corrosive and expensive. This is because when other halogen containing gases were used, especially chlorine-containing gases, the workpiece repassivated as soon as it was exposed to atmospheric oxygen between activation and thermal hardening. In this early work, therefore, only those activated workpieces which contained significant amounts of fluorine atoms could be exposed to the atmosphere without immediately repassivating.

In accordance with another feature of this invention, this trade-off between the undesirable corrosion and expense associated with using fluorine-based activators and the undesirable need to avoid repassivation when chlorine-based activators are used has been broken, since it has been found that the activated workpieces produced by this invention do not readily repassivate when exposed to atmospheric oxygen for 24 hours or longer, even though they are free of fluorine atoms.

Temperature Ramping Protocols

Overview

Figure 2:
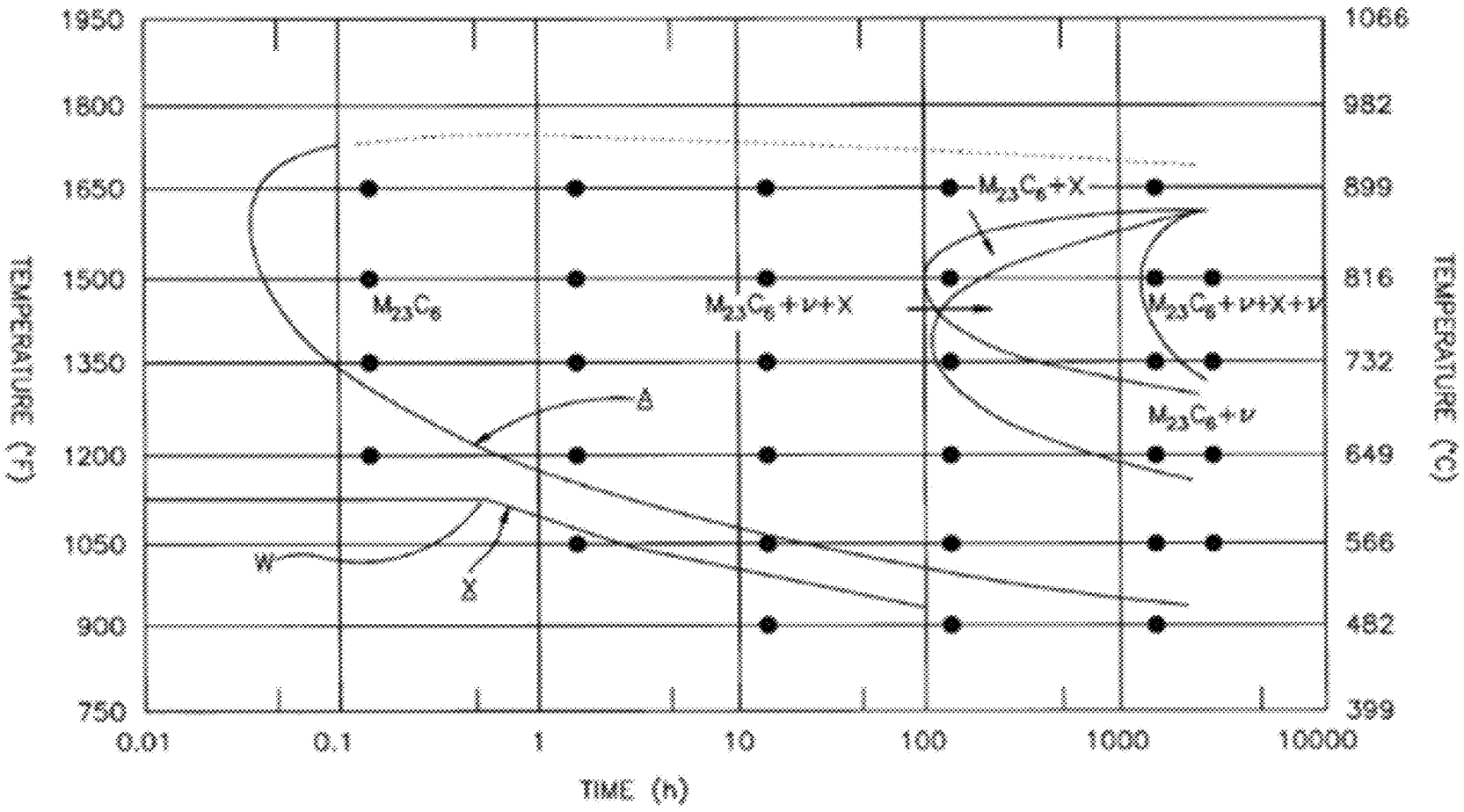
FIG. 2 shows several temperature ramping protocols superimposed on the TTT of FIG. 1.
Figure 3:
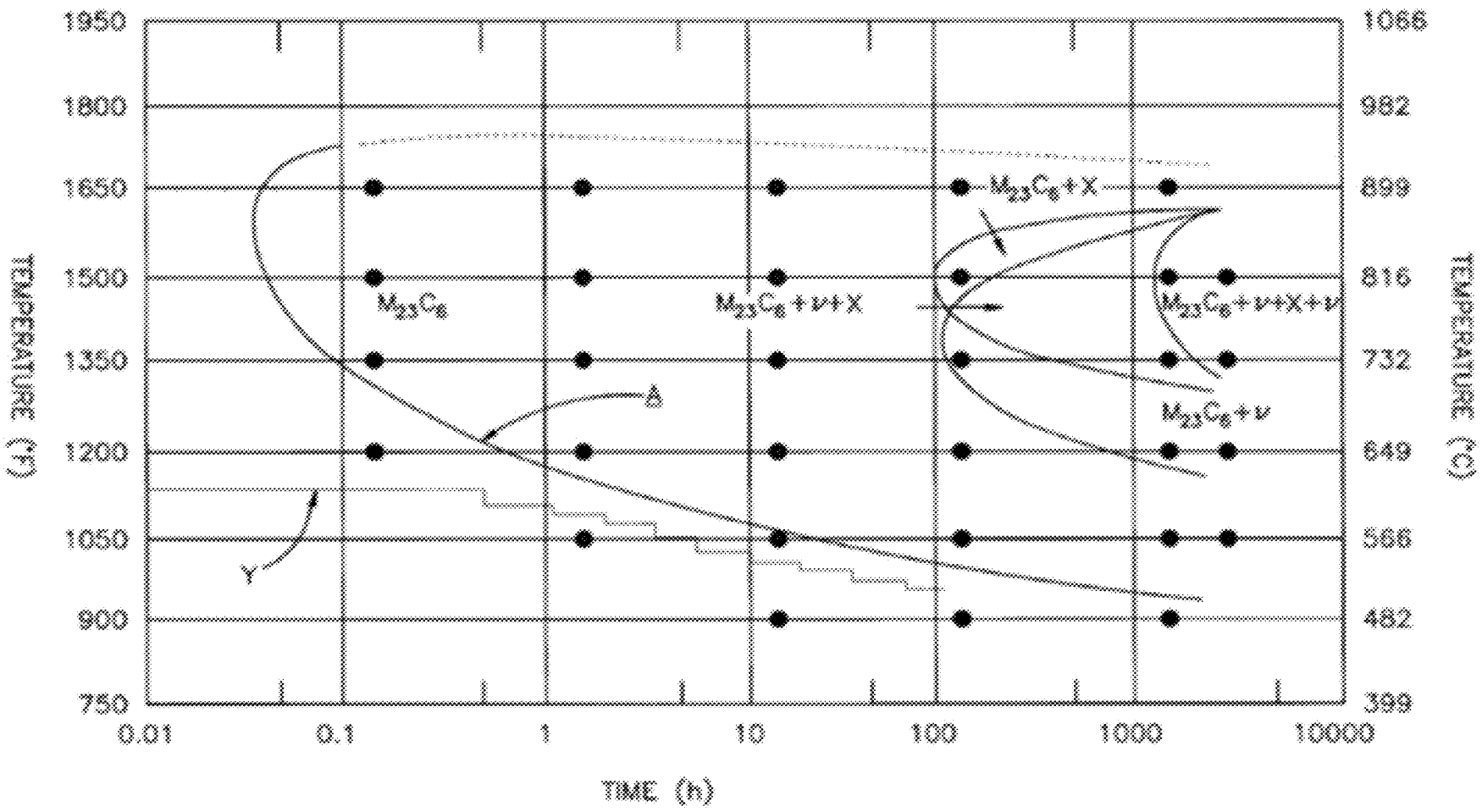
FIG. 3 shows more temperature ramping protocols superimposed on the TTT of FIG. 1.

The Applicants have developed methods of low temperature hardening that are effective on the time scale of hours, not days (in contrast with the methods shown and discussed above, particularly in the context of FIGS. 1-3). Therefore, the Applicants needed to develop new methods of temperature adjustment, or ramping, during hardening to facilitate these faster hardening processes. In particular, the Applicants developed temperature ramping procedures that optimize activation and/or hardening while still avoiding the formation of deleterious precipitates under these unprecedented time scales.

Development of Fast Low Temperature Hardening

As discussed above, results show that at least DmbgHCl, GuHCl, and BgHCl have successfully induced extremely rapid surface hardening under low temperature conditions. Specifically, 8 mg of either reagent, tested separately, was able to achieve 20-24 μm of a hardened case depth after 2 hours of low temperature (500° C.) treatment. As evident from the above discussion, this is much faster than the treatments discussed in the context of FIGS. 1-3.

In these studies, the hardened case is formed the walls of a cylindrical crucible pan made of 316SS (UNS 531600) stainless steel. An image of an exemplary pan 1 appears in FIG. 4. The pans have a diameter of about 0.5 cm and a height of about 0.5 cm. The pans are machined out of round bar stock using standard metal cutting tools. There were no other significant surface preparations. The machined surfaces of pan 1 likely have a Beilby layer. Testing was conducted using a Netzsch Simultaneous Thermal Analysis (STA) equipment.[18]

Pans 1 were case-hardened according to the procedures disclosed in U.S. Pat. No. 10,214,805, with the following modifications:

TABLE 4

| | U.S. Pat. No. 10,214,805 | Hardening of Metal in Pan[19] in the present disclosure |
|---|---|---|
| Equipment providing surface treatment | Clam shell heater. | Netzsch Simultaneous Thermal Analysis (STA) equipment. |
| Reaction vessel conditions | Constant volume (sealed glass vessel). | Constant pressure (reaction vessel vented). |
| Hydration conditions | Not fully dehydrated - exposed to ambient moisture.[20] | Dehydrated.[21] |
| Exposure time | As low as 2 hours. | As low as 1 minute for a 316SS workpiece. |
| Activating reagent | Various | Dimethylbiguanide HC1 (DmbgHC1): 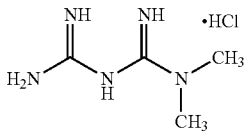 Guanidine HCl (GuHCl): |

TABLE 4-continued

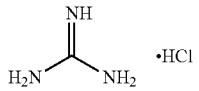

Biguanide HCl (BgHC1)

[18]The Netzsch Simultaneous Thermal Analysis (STA) equipment is described in more detail in "Fourier Transform of Infrared (FT-IR) Spectrometers Coupled to Thermal Analysis: Concepts, Instruments and Applications from RT to 2000° C., Analyzing and Testing," NGB - FTIR - EN - 0220 - NWS, attached as Exhibit A.

[19]E.g., pan 1 in FIG. 4.

[20]Testing showed that moisture reacts and causes chemical changes with various reagents used in U.S. Pat. No. 10,214,805.

[21]Activating reagents placed in pan and heat dehydrated just prior to hardening.

[22]The basic stmcture of triguanide is as follows:

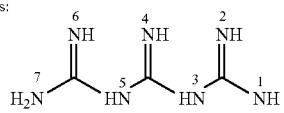

The guanidine [$HNC(NH_2)_2$] moiety or functionality with HCl complexing is the chemical structure common to both DmbgHCl, BgHCl, and GuHCl. Other reagents tested lacking the guanidine moiety have not demonstrated producing ~20 μm case depth in 2 hours or less under similar conditions. As shown in Table 4, the Applicants found that these reagents can unexpectedly shorten exposure treatment times from 2 hours to 1 minute with comparable hardening effect.

Examples of suitable guanides, biguanides, biguanidines and triguanides[22] for use in this aspect of the present disclosure include chlorhexidine and chlorohexidine salts, analogs and derivatives, such as chlorhexidine acetate, chlorhexidine gluconate and chlorhexidine hydrochloride, picloxydine, alexidine and polihexanide. Other suitable examples include chlorproguanil hydrochloride, proguanil hydrochloride (currently used as antimalarial agents), metformin hydrochloride, phenformin and buformin hydrochloride (currently used as antidiabetic agents).

While the results herein discuss using guanidine moiety containing compounds with HCl complexing, these results may also be obtained with guanidine moiety reagents without HCl complexing. Reagent complexing with any hydrogen halide may achieve similar results. Guanidine moiety reagents without HCl complexing may also be mixed with other reagents, such as the other reagents discussed in U.S. Pat. No. 10,214,805, having HCl complexing. An important criteria may be whether the reagent or mix of reagents has a liquid phase while decomposing in the temperature ranges of low temperature nitrocarburization (e.g., 450 to 500 C). The extent to which reagents evaporate without decomposing, before reaching that temperature range is an important consideration.

Temperature Treatment During Fast Hardening

The Applicants share the goal of the works cited above, particularly U.S. Pat. No. 6,547,888, with regard to determining temperature treatment protocols to accelerate or facilitate low temperature hardening. Since the advancements discussed above in reagent technology have accelerated treatment times from days to hours, the Applicants have developed an entirely new protocol. Their intent, among other things, is to use the temperature profile to optimize the intensity of reagent vapors at the key points during treatment.

Temperature Ramp-Up Protocol

Unlike the temperature adjustment protocols of the references cited above, which focus on decreasing temperature to avoid precipitate formation, the Applicants developed a temperature ramp-up protocol. One purpose of the ramp-up, among other things, is accelerate production of the product (either for activation or hardening) of thermal degradation of reagent. In particular, the Applicants believe that activation of the workpiece for nitriding and/or carburizing may be a rate limiting step to hardening. Thus, higher temperature heating need not be employed until this rate limiting step is overcome and activation is substantial. Before that, additional heating does not effectively assist hardening. They developed a heating protocol that begins at relatively low temperature while the activation process proceeds. Once activation is substantial enough to allow nitrogen and carbon to harden the workpiece, the protocol provides an intensive, "pulse" heating step. This intensive pulse decomposes the reagent and provides carbon and nitrogen for hardening at the appropriate time.

Figure 7:
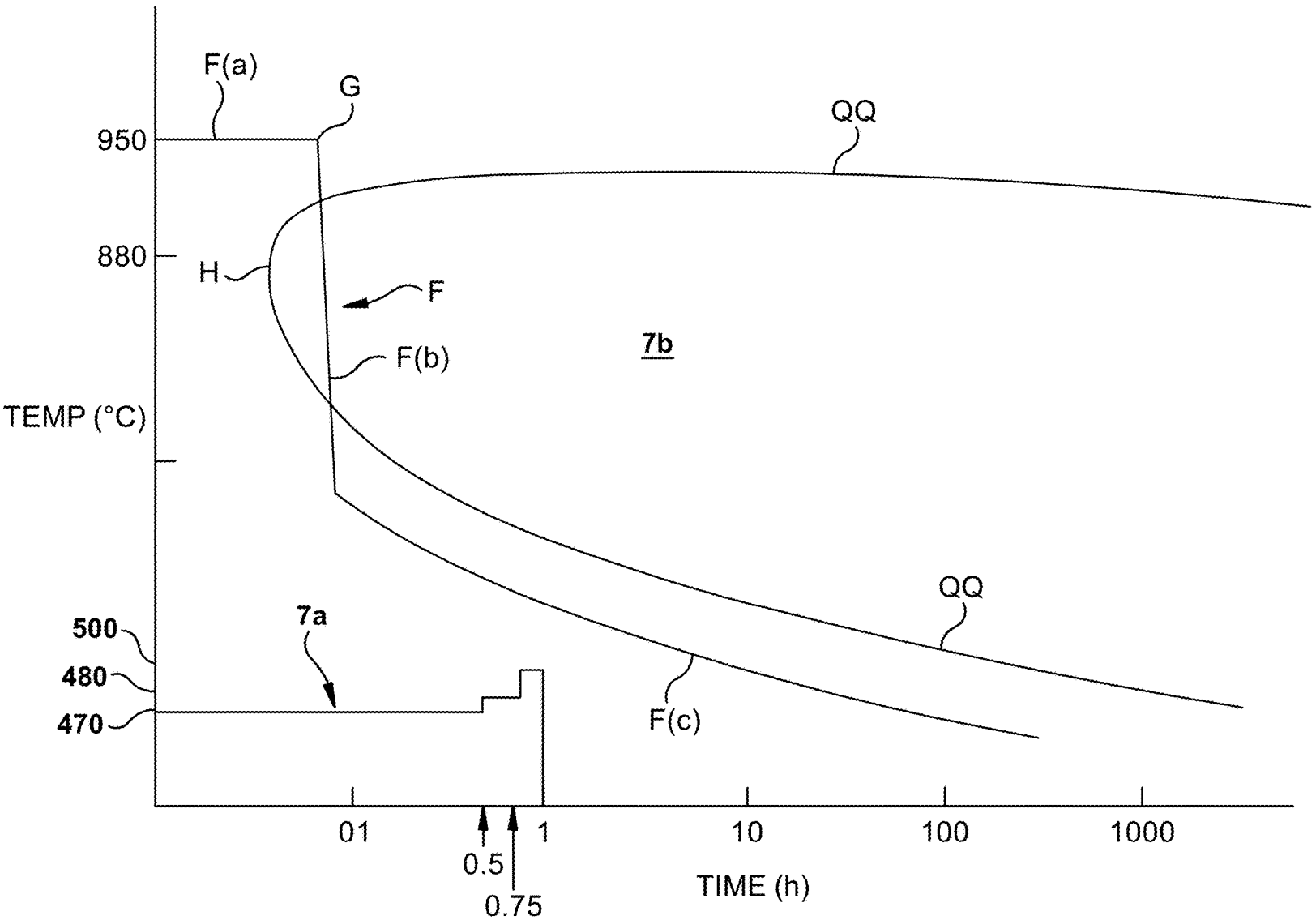
FIG. 7 shows an exemplary ramp up temperature protocol superimposed on a TTT phase diagram for 316SS (UNS S31600).

An exemplary temperature ramp-up protocol appears in FIG. 7. FIG. 7 is a TTT phase diagram for 316SS (UNS 531600) reproduced from FIG. 2 of U.S. Patent Application Publication No. 2010/0116377. The newly proposed temperature ramp-up protocol is shown in FIG. 7 as annotated line 7*a*. The region in the TTT diagram where precipitates form is labeled 7*b*. Precipitate region 7*b* is bounded by curve QQ. It is to be understood that the temperature ramp 7*a* in FIG. 7 is merely suggestive of an advantageous temperature ramp-up protocol. The specific temperatures and times shown in FIG. 7 and associated with temperature ramp 7*a* are not meant to be exact or precise. Rather, they are meant to illustrate the physical and chemical changes desired by the temperature ramp-up protocol of the instant disclosure.

As shown in FIG. 7, an initial stage is to heat the reagent at 470° C. for 30 minutes. This stage may facilitate activation of the workpiece. Subsequently, this initial heating is ramped up to 480° C. for 15 minutes. Finally, in the last 15 minutes of the first hour of heat treatment, the heating is ramped up to 500° C. Ramping-up the temperature this way provides a "pulsed," or relatively large increase in heating within the first 1 hour of heat treatment at the maximum temperature of 500° C., but for a relatively short period of time (e.g., 15 minutes). One of the purposes of the pulse is to provide sufficient heat for decomposing the reagent to provide nitrogen and carbon to the hardening process after earlier heating has sufficiently activated the workpiece. Again, these particular times and temperatures are merely illustrative. They illustrate a pulsed heating protocol that may enhance or increase the ability of decomposition of the reagent to activate the workpiece in the first hour of treatment. It is to be understood that modifying these particular times and temperatures would still be within the context of the present disclosure so long as these or similar results were obtained in a similar way. An exemplary alternative variant of protocol 5*a* is: 500° C. for 0.5 hours, 510° C. for 0.25 hours, 530° C. for 0.25 hours. More generally, ramp-up protocols disclosed herein can vary temperatures from at least 450° C. or greater to 550° C. or less, although even greater temperature ranges are possible. The delta, or step-wise variation in temperature, can be at least 100° C. or less.

The temperature protocol 7*a* in FIG. 7 is a step-wise protocol. This may be advantageous with regard to practical considerations (e.g., in view of limitations of experimental or production heating equipment), as discussed above in the context of FIG. 3. However, the step-wise form of 7a is meant to be illustrative and non-limiting. It is to be understood the same effects described herein could be accomplished with a smooth, or partially-smooth, temperature protocol and still be within the context of this disclosure.

The heating protocol 7*a* may simultaneously accomplish multiple goals. First, it may provide as much heat as possible to the reagent in order to facilitate hardening and/or activation of the surface to be treated. Second, it may avoid forming carbide or nitride precipitates by entering region 7*b* of FIG. 7. Third, protocol 7*a* may address heat capacity issues by allowing enough time to "preheat" the reagent to obtain a reagent bulk temperature sufficient to ramp through the peak (e.g., 500° C. at 1 hour, in FIG. 7). Once the peak is reached, the heating is relaxed (FIG. 7, post 1 hr). In this way, heating protocol 7*a* may optimize an intensity of a pulse or surge in vapors from the reagent causing hardening of the workpiece at key points of treatment (e.g., from 45 min-1 hour in the heat treatment shown in FIG. 7). As discussed above, such a heat treatment may "open" or activate the workpiece for nitrogen and carbon during hardening, and/or accelerate the actual hardening through carburization and/or nitrocarburization.

Heating protocol 7*a* may also or alternatively facilitate an initial loading in the work piece with interstitial carbon and nitrogen atoms at lower temperature, then proceed to higher temperatures. This may generate fine carbides disclosed herein, without generating coarse carbides (or nitrides). The initial loading is believed to inhibit coarse carbide and nitride formation.

Temperature Ramp-Down Protocol

In addition to the ramp-up heat treatment discussed above, the Applicants have also developed a temperature ramp-down treatment for fast hardening on order of hours, rather than days. A purpose of the ramp-down treatment is to maintain a high temperature of the workpiece during activation and hardening without precipitating carbides or nitrides. As discussed above, the higher temperatures drive kinetics of both the activation and hardening processes, as well as decomposition of the reagent.

Figure 8:
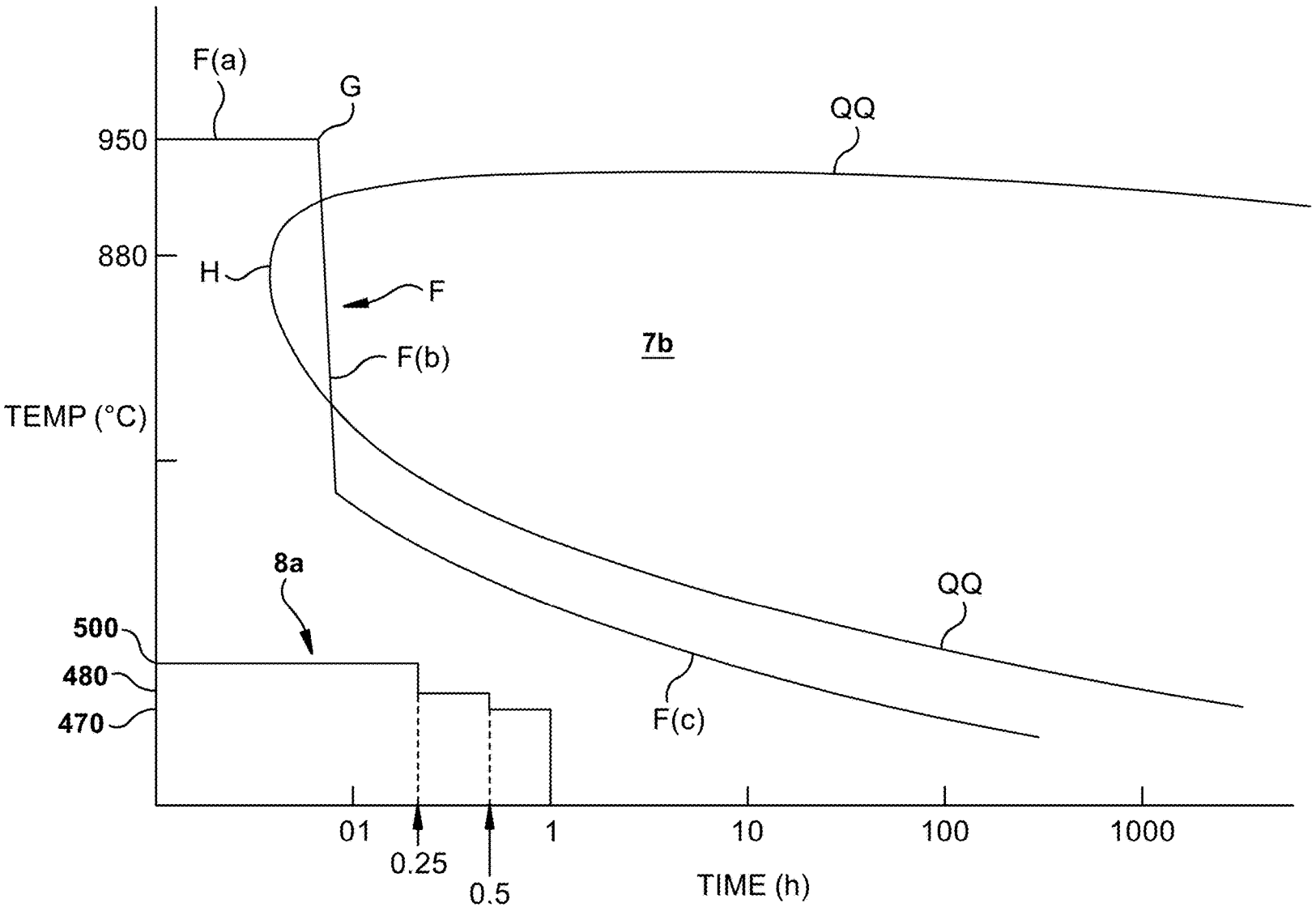
FIG. 8 shows an exemplary ramp down temperature protocol superimposed on the TTT phase diagram in FIG. 7.

An exemplary temperature ramp-up protocol appears in FIG. 8. FIG. 8 is the same TTT diagram for 316SS (UNS 531600) as in FIG. 7. The newly proposed temperature ramp-down protocol is shown in FIG. 8 as annotated line 8*a*. The region in the TTT diagram where precipitates form is labeled 7*b*, same as in FIG. 7. Again, precipitate region 7*b* is bounded by curve QQ. It is to be understood that protocol 8*a* in FIG. 8 is merely suggestive of an advantageous temperature ramp-down protocol. The specific temperatures and times shown in FIG. 8 and associated with temperature ramp 8*a* are not meant to be exact or precise. Rather, they are meant to illustrate the physical and chemical changes desired by the temperature ramp-down protocol of the instant disclosure.

The temperature protocol 8*a* in FIG. 8 is a step-wise protocol. This may be advantageous with regard to practical considerations (e.g., limitations of experimental or production heating equipment), as discussed above in the context of FIG. 3. However, the step-wise form of 8*a* is meant to be illustrative and non-limiting. It is to be understood the same effects described herein could be accomplished with a smooth, or partially-smooth, temperature protocol and still be within the context of this disclosure.

As shown in FIG. 8, an initial stage is to heat the reagent at 500° C. for 15 minutes. Subsequently, this initial heating is ramped down to 480° C. for 15 minutes. Finally, in the last 30 minutes of the first hour of heat treatment, the heating is ramped down to 470° C. Ramping-down the temperature this way avoids curve QQ in the TTT diagram of FIG. 8, thus avoiding precipitate region 7*b*. In other words, temperature protocol 8*a* provides an increased heating of the reagent and workpiece during activation and hardening, while avoiding precipitate formation. This increased heating may advantageously increase kinetics of the reagent decomposition, activation, and/or hardening. Again, these particular times and temperatures are merely illustrative. They illustrate a ramp-down heating protocol that may increase decomposition, activation, and/or hardening kinetics. It is to be understood that modifying these particular times and temperatures would still be within the context of the present disclosure so long as these or similar results were obtained in a similar way. An exemplary alternative variant of protocol 6*a* is: 530° C. for 0.25 hours, 510° C. for 0.25 hours, 500° C. for 0.5 hours. More generally, ramp-down protocols disclosed herein can vary temperatures from at least 450° C. or greater to 550° C. or less, although even greater temperature ranges are possible. The delta, or stepwise variation in temperature, can be at least 100° C. or less.

Rapid Protocol for 15-20 μm Hardened Layer in 60 Second Treatment

In addition to the above, the Applicants developed a hardening protocol that produced a 15-20 μm hardened layer in approximately 60 seconds of reagent treatment. Samples were created from 1/16" back ferrules made from 316SS steel. In the hardening process, the samples were exposed to vapors formed by heating the following reagents: biguanide HCl, 1,1-dimethylbiguanide HCl and GuHCl. Both reagents produced a 15-20 μm hardened case depth in the ferrule samples.

The temperature protocol was as follows. First, the samples were linearly ramped up from room temperature to approximately 600° C. The ramp-up was conducted at a rate of 25° C./minute. Once 600° C. was reached, that temperature was held for 60 seconds while the samples were exposed to reagent vapors. Subsequently, the samples were then cooled to room temperature at a rate of 20° C./minute.

Figure 9:
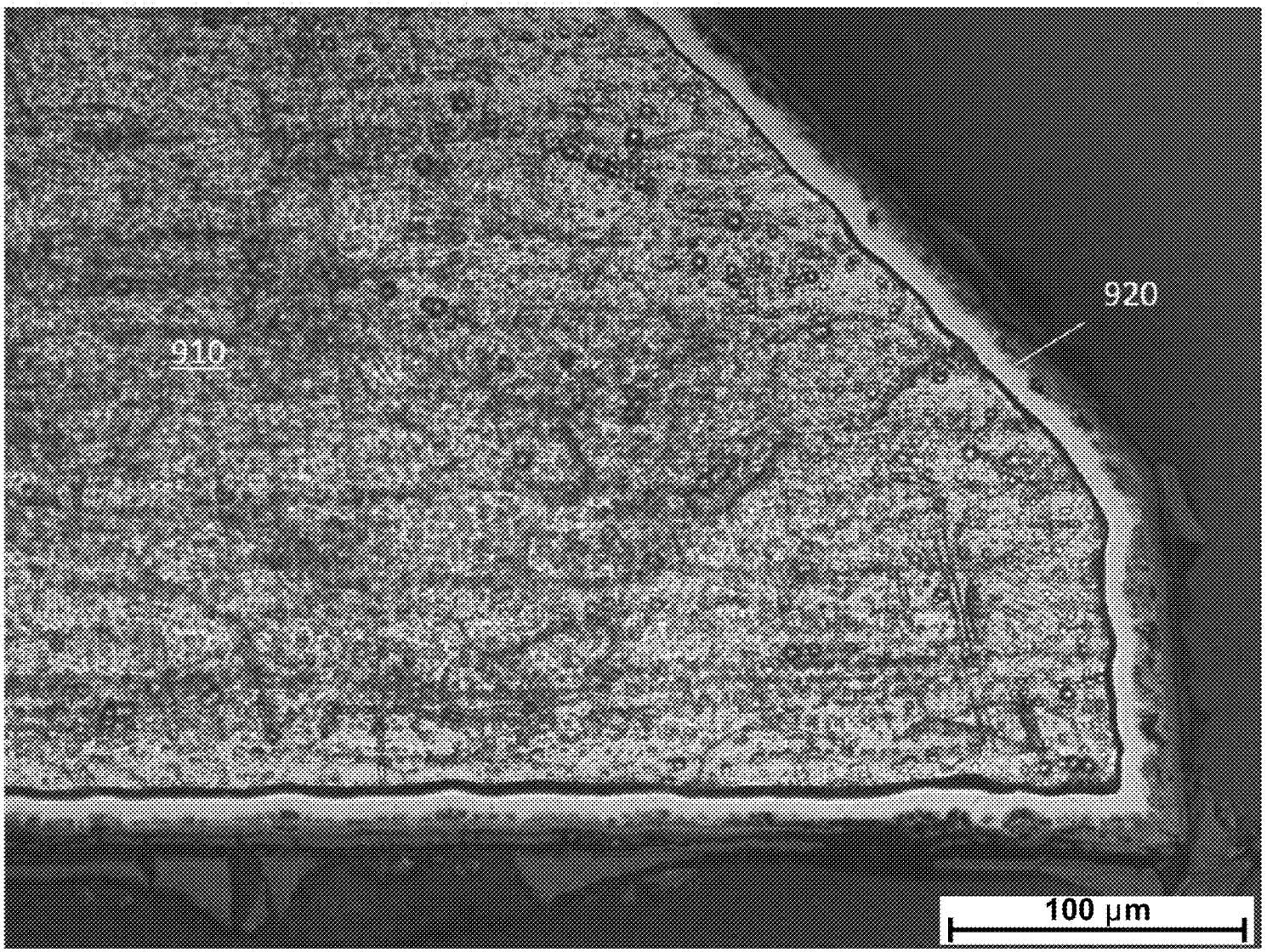
FIG. 9 shows an optical image of the surface of a treated 316L stainless steel ferrule.

FIG. 9 shows an optical image of a cross-section of the surface of a 316L stainless steel ferrule 910 treated in the manner just described. The protocol produced a relatively even hardened case 920 around the ferrule sample periphery. ASTM G61 Cyclic Potentiodynamic Polarization (CPP) testing showed the treated ferrules 910 to be transpassive at about 900 mV, indicating relatively high corrosion resistance. These results suggest that the hardened outer layer includes one or more of a dispersion of fine metal carbide precipitates, dispersion of fine metal nitride precipitates, coarse metal carbide precipitates suspended in a corrosion resistant solid solution treated metal phase, and coarse metal nitride precipitates suspended in a corrosion resistant solid solution treated metal phase. If precipitates were not a dispersion or not suspended in a corrosion resistant solid solution treated metal phase, the CPP testing would have revealed pitting corrosion a lower mV value than 900 mV.

Combinations of Heating Protocols

Although heating protocols 7*a* and 8*a* are presented separately above, it is to be understand that they may be performed in combination. For example, it may be advantageous to perform the heating pulse of protocol 7*a* subsequent to, or before, protocol 8*a*. Other combinations and variations are possible and all are included within the context of this disclosure.

Implications

The above-describe developments have considerable economic impact. The heating protocols 5*a* and 6*a*, as well as the variations discussed above, may shorten hardening times to even less than the two hours reported above for the guanidine-based reagents (and others). Hardening times of 1 hour or less are possible. Rapid, 1-2 hour, or less, case hardening treatment can be used in continuous conveyer belt production of hardened workpieces under a nitrogen (or other atmosphere) purge. Reagent (e.g., DmbgHCl and GuHCl) may be sprayed directly on workpieces (e.g., ferrules) as they move on the belt. Alternatively, the workpieces can be pretreated with the reagent in some form (coated with a water or oil based coating, powder coated, etc.). This would greatly improve the production volume and rapidity of hardened components.

The temperatures to which the workpiece is subjected during activation and/or hardening in accordance with this invention should be high enough to achieve activation but not so high that nitride and/or carbide precipitates form.

In this regard, it is well understood in low temperature surface hardening processes that if the workpiece is exposed to temperatures which are too high, unwanted nitride and/or carbide precipitates form. In addition, it is also understood that the maximum surface hardening temperature a workpiece can tolerate without forming these nitride and/or carbide precipitates depends on a number variables including the particular type of low temperature surface hardening process being carried out (e.g., carburization, nitriding or carbonitriding), the particular alloy being surface hardened (e.g., nickel-based vs. iron-bases alloys) and the concentration of the diffused nitrogen and/or carbon atoms in the workpiece surfaces. See, for example, commonly-assigned U.S. Pat. No. 6,547,888. So, it is also well understood that in carrying out low temperature surface hardening processes, care must be taken to avoid surface hardening temperatures which are too high in order that formation of nitride and/or carbide precipitates is avoided.

In the same way, in carrying out the inventive activation and/or hardening process, care should also be taken to ensure that the temperature to which the workpiece is exposed during activation is not so high that unwanted nitride and/or carbide precipitates form. Generally, this means that the maximum temperature to which the workpiece is exposed during activation and simultaneous and/or subsequent surface hardening should not exceed about 700° C., in some cases 600° C., preferably 500° C., or, in others, even 450° C., depending on the particular alloy being treated. So, for example, when nickel-based alloys are being activated and surface hardened, the maximum processing temperature can be as high as about 700° C., as these alloys may not form nitride and/or carbide precipitates until higher temperatures are reached. On the other hand, when iron-based alloys such as stainless steels are being activated and surface hardened, the maximum processing temperature should desirably be limited to about 475° C., preferably 450° C., as these alloys tend to become sensitive to the formation of nitride and/or carbide precipitates at higher temperatures.

In terms of minimum processing (i.e., activation and/or hardening) temperature, there is no real lower limit other than the fact that the temperatures of both the non-polymeric N/C/H compound and the workpiece itself must be high enough so that the workpiece becomes activated as a result of the vapors that are produced. Normally, this means the non-polymeric N/C/H compound will be heated to a temperature of ≥100° C., although more preferably the non-polymeric N/C/H compound will be heated to a temperature of ≥150° C., ≥200° C., ≥250° C., or even ≥300° C. Activation temperatures of ≥350° C., ≥400° C., or even ≥450° are contemplated.

The time it takes a particular alloy to become activated for low temperature surface hardening, and/or surface hardened, in accordance with this invention also depends on many factors including the nature of the alloy being activated, the particular non-polymeric N/C/H compound being used and the temperature at which activation occurs. Generally speaking, activation and/or hardening can be accomplished in as short as 1 second to as long as 3 hours. However, alloys can become sufficiently activated in 1 to 150 minutes, 1 to 120 minutes, 1 to 90 minutes, 1 to 75 minutes, 1 to 60 minutes, including 5 to 120 minutes, 10 to 90 minutes, 20 to 75 minutes, or even 30 to 60 minutes. Hardening may occur simultaneously or subsequently with activation. In any case, hardening may occur on a similar time scale as activation. The period of time it takes a particular alloy to become sufficiently activated by the inventive process can be determined on a case-by-case basis. Moreover, in those instances in which activation and surface hardening occur simultaneously, whether or not additional nitrogen and/or carbon compounds are included in the system for augmenting surface hardening, the minimum time for activation will normally be determined by the minimum time needed to complete the surface hardening process.

As for pressure, the inventive activation and/or hardening processes can be carried out at atmospheric pressure, above atmospheric pressure or at subatmospheric pressures including a hard vacuum, i.e., at a total pressure of 1 torr (133 Pa (Pascals) or less as well as a soft vacuum, i.e., a total pressure of about 3.5 to 100 torr (~500 to ~13,000 Pa (Pascals)).

FURTHER WORKING EXAMPLES

In order to more thoroughly describe this invention, the following working examples are provided.

Example 1

A machined workpiece made from A1-6XN alloy, which is a super-austenitic stainless steel characterized by an elevated nickel content, was placed in a laboratory reactor along with powdered 2-aminobenzimidazole as an activating compound arranged to directly contact the workpiece. The reactor was purged with dry Ar gas and then heated to and held at 327° C. for 60 minutes, after which the reactor was heated to and held at 452° C. for 120 minutes.

After removal from the reactor and cooling to room temperature, the workpiece was examined and found to have a conformational and uniform case (i.e., surface coating) exhibiting a near surface hardness of 630 HV.

Example 2

Example 1 was repeated, except that the activating compound was composed of a mixture of guanidine hydrochloride and 2-aminobenzimidazole in a mass ratio of 0.01 to 0.99. In other words, the amount of guanidine hydrochloride used was 1 wt. %, based on the total amount of non-polymeric N/C/H compounds used. In addition, the reactor was heated to and held at 452° C. for 360 minutes instead of 120 minutes.

The work piece was found to exhibit a near surface hardness of 660 HV.

Example 3

Example 2 was repeated, except that the workpiece was made from AISI 316 stainless steel and the activating compound was composed of a mixture of guanidine hydrochloride and 2-aminobenzimidazole. In a first run, the mass ratio of guanidine hydrochloride to 2-aminobenzimidazole was 0.01 to 0.99 (1 wt. % guanidine hydrochloride based on the total amount of non-polymeric N/C/H compounds used), while in a second run this mass ratio was 0.10 to 0.90 (10 wt. % guanidine hydrochloride based on the total amount of non-polymeric N/C/H compounds used).

The work piece produced in the first run exhibited a near surface hardness of 550 HV, while the work piece produced in the second run exhibited a near surface hardness of 1000 HV. In addition, the case-hardened surface of the workpiece produced in the second run exhibited a superior case depth and complete conformality over its entire surface as compared with the case-hardened surface of the workpiece produced in the first run.

Example 4

Example 3 was repeated except that the activating compound used was a mixture of guanidine hydrochloride and 2-aminobenzimidazole in a mass ratio of 0.50 to 0.50 (50 wt. % guanidine hydrochloride based on the total amount of non-polymeric N/C/H compounds used).

The hardened surface or "case" of the workpiece obtained exhibited a near surface hardness of 900 HV, with mostly complete conformality over its entire surface, but with some pitting.

Although only a few embodiments of this invention have been described above, it should be appreciated that many modifications can be made without departing from the spirit and scope of this invention. All such modifications are intended to be included within the spirit and scope of this invention, which is to be limited only by the following claims:

We claim:

1. A method for treating a workpiece made from a self-passivating metal and having a Beilby layer comprising:

nitrocarburizing the workpiece, wherein the nitrocarburizing consists of exposing the workpiece to vapors produced by heating a reagent having a guanidine [$HNC(NH_2)_2$] moiety and complexed with HCl for a time period of 1 to 5 minutes.

2. The method of claim 1, further comprising:

maintaining a reaction vessel containing the workpiece at a temperature of 700°° C. or less during the exposing; and wherein exposing the workpiece to the vapors forms a treated surface layer in the workpiece, the treated surface layer having a carbon concentration of 5 to 15 atomic % and being substantially free of coarse carbide or coarse nitride precipitates.

3. The method of claim 2, wherein:

the treated surface layer comprises fine carbide precipitates; and nitrogen in the treated surface layer is present primarily as at least one of interstitial nitrogen and fine nitride precipitates.

4. The method of claim 3, wherein:

the fine carbide precipitates do not substantially degrade corrosion resistance provided by a surface passivation layer in the workpiece; and the surface passivation layer includes chromium oxide.

5. The method of claim 1 wherein at least one of:

exposing the workpiece to the vapors further comprises maintaining a reaction vessel containing the workpiece at a temperature of 700° C. or less during the exposing; and the reagent includes at least one of Dimethylbiguanide HCl, Guanidine HCl, Biguanide HCl, and Melamine HCl-.

6. The method of claim 1 wherein exposing the workpiece to the vapors further comprises forming a case-hardened layer that is less than 30 μm thick and comprises:

an outer sublayer that is rich in interstitial nitrogen; and an inner sublayer that is rich in interstitial carbon.

7. The method of claim 6, wherein the case-hardened layer is less than 20 μm thick.

8. The method of claim 1, wherein the reagent includes at least one of an oxygen-free nitrogen halide salt and a non-polymeric N/C/H compound.

9. The method of claim 1, wherein exposing the workpiece to the vapors occurs with the workpiece in a reaction vessel at a distance of 8 inches (20 cm) or more from the reagent.

10. The method of claim 1, wherein exposing the workpiece to the vapors comprises:

applying a heating protocol that ramps from a lower temperature to a higher temperature during the exposing to enhance decomposition of the reagent and/or surface harden the workpiece.

11. The method of claim 10, wherein the lower temperature is approximately 450° C. or greater and the higher temperature is approximately 550° C. or less.

12. The method of claim 10, wherein applying the heating protocol comprises pulsing from the lower temperature to the higher temperature.

13. The method of claim 10, wherein the heating protocol is as follows:

maintain a temperature of substantially 500° C. for approximately 15 minutes;

ramp the temperature from approximately 500° C. to approximately 480° C.;

maintain a temperature of 480° C. for approximately 15 minutes;

ramp the temperature from approximately 480° C. to approximately 470° C.; and maintain a temperature of 470° C. for approximately 30 minutes.

14. A workpiece made according the method of claim 1.

15. A method for treating a workpiece made from a self-passivating metal and having a Beilby layer comprising:

exposing the workpiece to the vapors produced by heating a reagent having a guanidine [$HNC(NH_2)_2$] moiety and complexed with HCl to activate the workpiece for low temperature interstitial surface hardening; and applying a heating protocol during the exposing that ramps from a lower to a higher temperature during the exposing to enhance decomposition of the reagent and/or surface harden the workpiece, wherein the heating protocol is as follows:

maintain a temperature of substantially 470° C. for approximately 30 minutes;

ramp the temperature from approximately 470° C. to approximately 480° C.;

maintain a temperature of 480° C. for approximately 15 minutes;

ramp the temperature from approximately 480° C. to approximately 500° C.; and maintain a temperature of 500° C. for approximately 15 minutes.

16. A method for producing a case-hardened at least one component in continuous conveyer belt production comprising:

purging an atmosphere of the continuous conveyor belt with gas;

while maintaining the atmosphere at a temperature of 700° C. or less:

placing the at least one component on the continuous conveyor belt, with each of the at least one component comprising a self-passivating metal and having a Beilby layer;

nitrocarburizing the at least one component, wherein the nitrocarburizing consists of exposing the at least one component to vapors produced by heating a reagent having a guanidine $[HNC(NH_2)_2]$ moiety and complexed with HCl for a period of 1 to 5 minutes, whereby the at least one component is activated and surfaced hardened from exposure to the vapors.

17. The method of claim 16, wherein the at least one component comprises a plurality of components.

18. A component made according to the method of claim 16.

* * * * *